US007581937B2

(12) United States Patent
Nishikawa et al.

(10) Patent No.: US 7,581,937 B2
(45) **Date of Patent: *Sep. 1, 2009**

(54) ROTARY TYPE COMPRESSOR HAVING AN INTERMEDIATE PRESSURE ON A SURFACE SIDE OF ITS COMPRESSION MEMBER

(75) Inventors: Takahiro Nishikawa, Gunma-ken (JP); Hirotsugu Ogasawara, Ota (JP); Takao Kanayama, Gunma-ken (JP); Yoshiaki Hiruma, Ota (JP); Manabu Takenaka, Ota (JP); Masazumi Sakaniwa, Ota (JP); Akira Hashimoto, Ota (JP); Junichi Suzuki, Ota (JP)

(73) Assignee: Sanyo Electric Co., Ltd., Moriguchi-shi (JP)

( * ) Notice: Subject to any disclaimer, the term of this patent is extended or adjusted under 35 U.S.C. 154(b) by 7 days.

This patent is subject to a terminal disclaimer.

(21) Appl. No.: 11/808,844

(22) Filed: Jun. 13, 2007

(65) Prior Publication Data

US 2008/0031753 A1 Feb. 7, 2008

Related U.S. Application Data

(62) Division of application No. 11/219,889, filed on Sep. 7, 2005, now Pat. No. 7,481,635.

(30) Foreign Application Priority Data

Sep. 30, 2004 (JP) ..... 2004-286488
Sep. 30, 2004 (JP) ..... 2004-286497

(51) Int. Cl.
*F04C 18/00* (2006.01)
*F03C 4/00* (2006.01)

(52) U.S. Cl. ..... 418/232; 418/219

(58) Field of Classification Search ..... 418/62–64, 418/102, 104, 149, 216, 219, 230–232
See application file for complete search history.

(56) References Cited

U.S. PATENT DOCUMENTS 5,037,279 A * 8/1991 Suefuji et al. ..... 418/55.2

(Continued)

FOREIGN PATENT DOCUMENTS

JP 54108914 A * 8/1979 ..... 418/230

(Continued)

*Primary Examiner*—Theresa Trieu
(74) *Attorney, Agent, or Firm*—Kratz, Quintos & Hanson, LLP

(57) ABSTRACT

A compressor having a sealed container; a cylinder in which a compression space is constituted; a suction port and a discharge port which communicate with the compression space in the cylinder; a support member which closes an opening of the cylinder; a rotary shaft which is rotatably supported by a main bearing as a bearing formed on the support member; a compression member whose one surface crossing an axial direction of the rotary shaft is inclined continuously between a top dead center and a bottom dead center; a vane which is disposed between the suction port and the discharge port to abut on one surface side of the compression member and which partitions the compression space in the cylinder into a low pressure chamber and a high pressure chamber. A pressure of the compression member on the other surface side of the compression member is set to a value which is lower than tat of a pressure in the sealed container.

1 Claim, 25 Drawing Sheets

U.S. PATENT DOCUMENTS

| | | | | |
|---|---|---|---|---|
| 6,017,203 | A * | 1/2000 | Sugawa et al. | 418/55.5 |
| 7,114,930 | B2 * | 10/2006 | Ogasawara et al. | 418/232 |
| 7,381,040 | B2 * | 6/2008 | Ogasawara et al. | 418/232 |
| 2004/0109779 | A1 * | 6/2004 | Yang et al. | 418/219 |
| 2005/0152792 | A1 * | 7/2005 | Ogasawara et al. | 417/410.3 |

FOREIGN PATENT DOCUMENTS

| | | | | |
|---|---|---|---|---|
| JP | 58195091 | A * | 11/1983 | 418/232 |
| JP | 05-99172 | | 4/2003 | |
| JP | 2003-532008 | | 10/2003 | |

* cited by examiner

FIG. 18

| | Vane | One face of rotation shaft•compressed member |
|---|---|---|
| Oil specification for lubrication | Nitriding treatment of high-speed tool steel-based material (SKH) | Cemented quenching of chrome molybdenum steel or carbon steel<br>High-frequency quenching of chrome molybdenum steel or carbon steel<br>Grey cast iron•spherical graphite cast iron |
| | PVD treatment of high-speed tool steel-based material (SKH) | Cemented quenching of chrome molybdenum steel or carbon steel<br>High-frequency quenching of chrome molybdenum steel or carbon steel<br>Grey cast iron•spherical graphite cast iron<br>Nitriding treatment of grey cast iron or spherical graphite cast iron<br>Quenching of grey cast iron or spherical graphite cast iron |
| Applicable to compressor with non-lubrication specification | Carbon-based material | Cemented quenching of chrome molybdenum steel or carbon steel<br>High-frequency quenching of chrome molybdenum steel or carbon steel<br>Grey cast iron•spherical graphite cast iron |
| | Ceramic-based material | Cemented quenching of chrome molybdenum steel or carbon steel<br>High-frequency quenching of chrome molybdenum steel or carbon steel<br>Nitriding treatment of grey cast iron or spherical graphite cast iron<br>Quenching of grey cast iron or spherical graphite cast iron<br>Ceramic |
| | Fluorine resin or polyether ether ketone | Surface treatment of aluminum (alumite treatment)<br>Cemented quenching of chrome molybdenum steel or carbon steel<br>High-frequency quenching of chrome molybdenum steel or carbon steel<br>Nitriding treatment of grey cast iron or spherical graphite cast iron<br>Quenching of grey cast iron or spherical graphite cast iron |

ROTARY TYPE COMPRESSOR HAVING AN INTERMEDIATE PRESSURE ON A SURFACE SIDE OF ITS COMPRESSION MEMBER

This applications is a Divisional of prior application Ser. No. 11/219,889 filed on Sep. 7, 2005 now U.S. Pat. No. 7,481,635, the contents being incorporated herein by reference.

BACKGROUND OF THE INVENTION

The present invention relates to a compressor which compresses fluids such as refrigerants or air and discharges the compressed fluids.

Conventionally, for example, a refrigerator has employed a system of compressing a refrigerant by using a compressor and circulating the compressed refrigerant in a circuit. As such compressor systems in this case, there are available a rotary compressor called a rotary type compressor (e.g., see Japanese Patent Application Laid-Open No. 5-99172 (Document 1)), a scroll compressor, a screw compressor and the like.

The rotary compressor has advantages that a structure is relatively simple and production costs are low, but there is a problem of increases in vibration and torque fluctuation. In the scroll compressor or the screw compressor, there is a problem of high costs caused by bad workability while torque fluctuation is small.

Thus, there has been developed a system which disposes a swash plate as a rotary compression member in a cylinder and partitions compression spaces constituted below and above the swash plate by a vane to compress fluids (e.g., PCT No. 2003-532008 (Document 2)). According to the compressor of this system, there is an advantage of constituting a compressor which is relatively simple in structure and small in vibration.

However, in the case of the structure of the Patent Document 2, since a high pressure chamber and a low pressure chamber are adjacent to each other below and above the compression member (swash plate) in the entire region of the cylinder, a difference between high and low pressures is enlarged, and refrigerant leakage causes a problem of efficiency deterioration.

Especially, there have occurred problems that the refrigerant in the compression space formed in a surface of the compression member on a driving element side easily leaks between a rotary shaft and a bearing of the rotary shaft, and degradation of performance of the compressor is caused.

Furthermore, in the conventional constitution in which the compression spaces are constituted above and below the compression member, back pressures of the compression spaces cannot be controlled. Therefore, friction is generated between the compression member and the vane which abuts on the compression member or a member disposed facing the compression member, and the compression member is remarkably worn. Therefore, there has occurred a problem that durability is deteriorated, and a mechanical loss increases.

SUMMARY OF THE INVENTION

The present invention has been made to solve the aforementioned conventional technical problems, and an object of the present invention is to inhibit refrigerant leakage and enhance a performance of a compressor.

Another object of the present invention is to provide a highly efficient compressor while improving durability of the compressor and enhancing reliability.

A first aspect of the present invention is directed to a compressor comprising a compression element comprising a cylinder in which a compression space is constituted; a suction port and a discharge port which communicate with the compression space in the cylinder; a support member which closes an opening of the cylinder; a rotary shaft which is rotatably supported by a bearing formed on the support member; a compression member whose one surface crossing an axial direction of the rotary shaft is inclined continuously between a top dead center and a bottom dead center and which is disposed in the cylinder to be rotated by the rotary shaft and which compresses a fluid sucked from the suction port to discharge the fluid via the discharge port; a vane which is disposed between the suction port and the discharge port to abut on one surface of the compression member and which partitions the compression space in the cylinder into a low pressure chamber and a high pressure chamber; and a shaft seal which is disposed on an end portion of the bearing on a side opposite to the compression member and which abuts on the rotary shaft.

According to the first aspect of the present invention, since the shaft seal abutting on the rotary shaft is disposed in the bearing end portion on the side opposite to the compression member, an inner surface of the bearing is sufficiently sealed by the shaft seal, and it is possible to avoid in advance a disadvantage that a gas leaks from a clearance between the rotary shaft and the bearing.

Consequently, a volume efficiency can be improved, and the performance of the compressor can be enhanced.

A second aspect of the present invention is directed to a compressor comprising a compression element comprising a cylinder in which a compression space is constituted; a suction port and a discharge port which communicate with the compression space in the cylinder; a support member which closes an opening of the cylinder; a rotary shaft which is rotatably supported by a bearing formed on the support member; a compression member whose one surface crossing an axial direction of the rotary shaft is inclined continuously between a top dead center and a bottom dead center and which is disposed in the cylinder to be rotated by the rotary shaft and which compresses a fluid sucked from the suction port to discharge the fluid via the discharge port; a vane which is disposed between the suction port and the discharge port to abut on one surface of the compression member and which partitions the compression space in the cylinder into a low pressure chamber and a high pressure chamber; and a piston ring seal which is disposed on the rotary shaft disposed in a position corresponding to the bearing.

A third aspect of the present invention is directed to the above compressor, wherein the piston ring seal is disposed on the rotary shaft disposed in a position corresponding to an end portion of the bearing on one surface side of the compression member.

According to the second aspect of the present invention, since the piston ring seal is disposed in the rotary shaft in the position corresponding to the bearing, it is possible to avoid in advance the disadvantage that the gas leaks from the clearance between the rotary shaft and the bearing.

Moreover, when the piston ring seal is disposed in the rotary shaft in the position corresponding to the bearing end portion on one surface side of the compression member as in the third aspect of the present invention, sliding losses in the bearing end portion are reduced. Moreover, the volume efficiency by enhancement of sealability is simultaneously realized, and the performance can be enhanced.

Furthermore, since a plurality of piston ring seals are disposed, the sealability can be further enhanced.

A fourth aspect of the present invention is directed to a compressor comprising a driving element stored in a sealed container; and a compression element driven by a rotary shaft of the driving element, the compression element comprising a cylinder in which a compression space is constituted; a suction port and a discharge port which communicate with the compression space in the cylinder; a compression member whose one surface crossing an axial direction of the rotary shaft is inclined continuously between a top dead center and a bottom dead center and which is rotatably disposed in the cylinder and which compresses a fluid sucked from the suction port to discharge the fluid from the discharge port into the compression space; and a vane which is disposed between the suction port and the discharge port to abut on one surface of the compression member and which partitions the compression space in the cylinder into a low pressure chamber and a high pressure chamber, wherein a pressure of the compression member on the other surface side is set to a value which is lower than that of a pressure in the sealed container.

According to the fourth aspect of the present invention, the pressure of the compression member on the side of the other surface opposite to one surface of the compression member in which the compression space is constituted is set to a value which is lower than the pressure in the sealed container. Therefore, it is possible to reduce a force by which the compression member is pushed toward the one-surface side by the pressure on the other-surface side.

Consequently, the durability of the compression member is improved, mechanical losses are reduced, and the reliability can be enhanced.

BRIEF DESCRIPTION OF THE DRAWINGS

FIG. 18 is a diagram showing materials and working methods of members for use in one face of the compression member, a receiving face, and a vane;

DETAILED DESCRIPTION OF THE PREFERRED EMBODIMENTS

Embodiments of the present invention will be described hereinafter in detail with reference to the accompanying drawings. A compressor C of each embodiment described below constitutes, e.g., a refrigerant circuit of a refrigerator, and plays a role of sucking, compressing and discharging the refrigerant into the circuit.

First Embodiment

Figure 1:
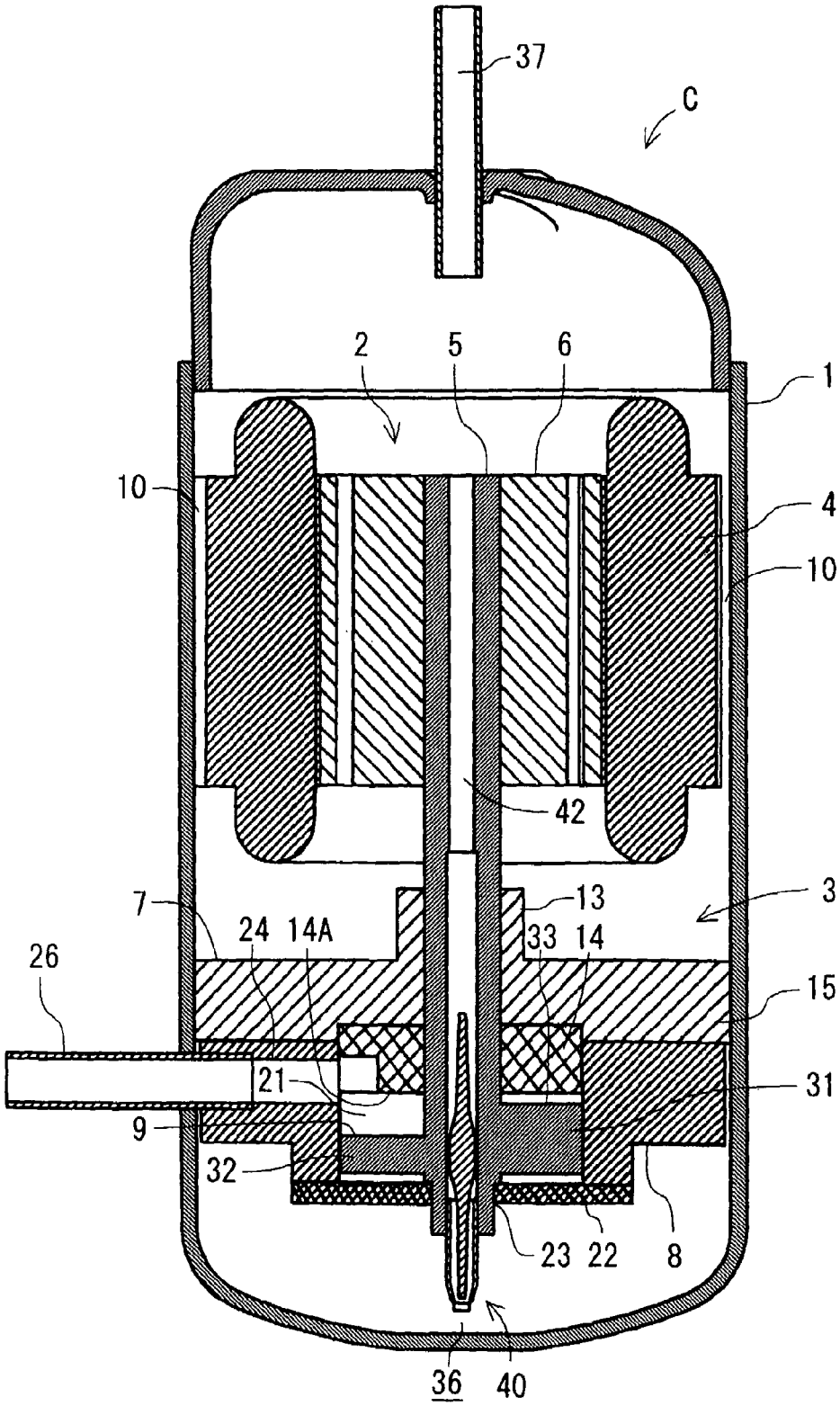
FIG. 1 is a vertical sectional side view of a compressor according to a first embodiment of the present invention.
Figure 2:
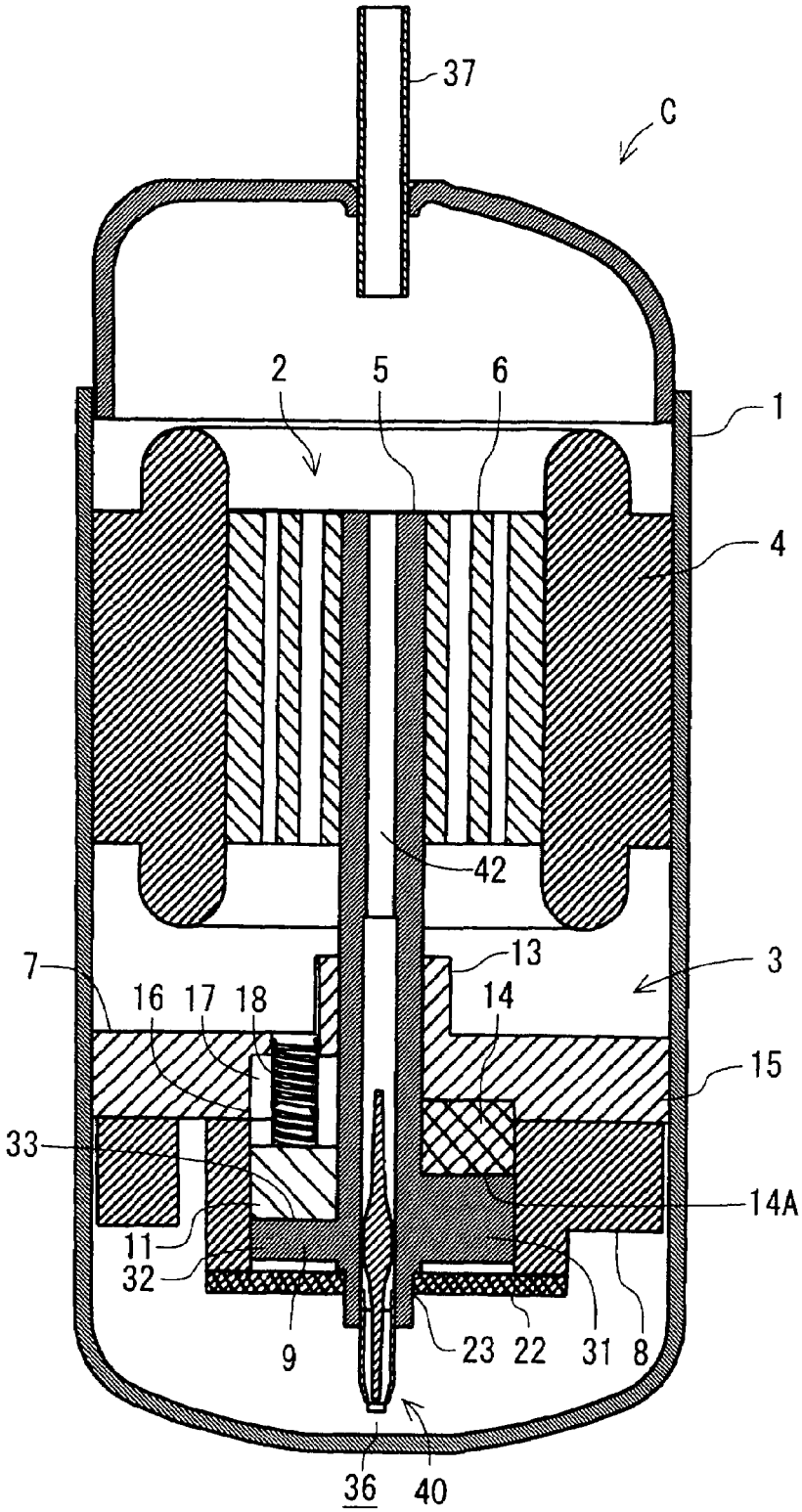
FIG. 2 is another vertical sectional side view of the compressor of FIG. 1.
Figure 3:
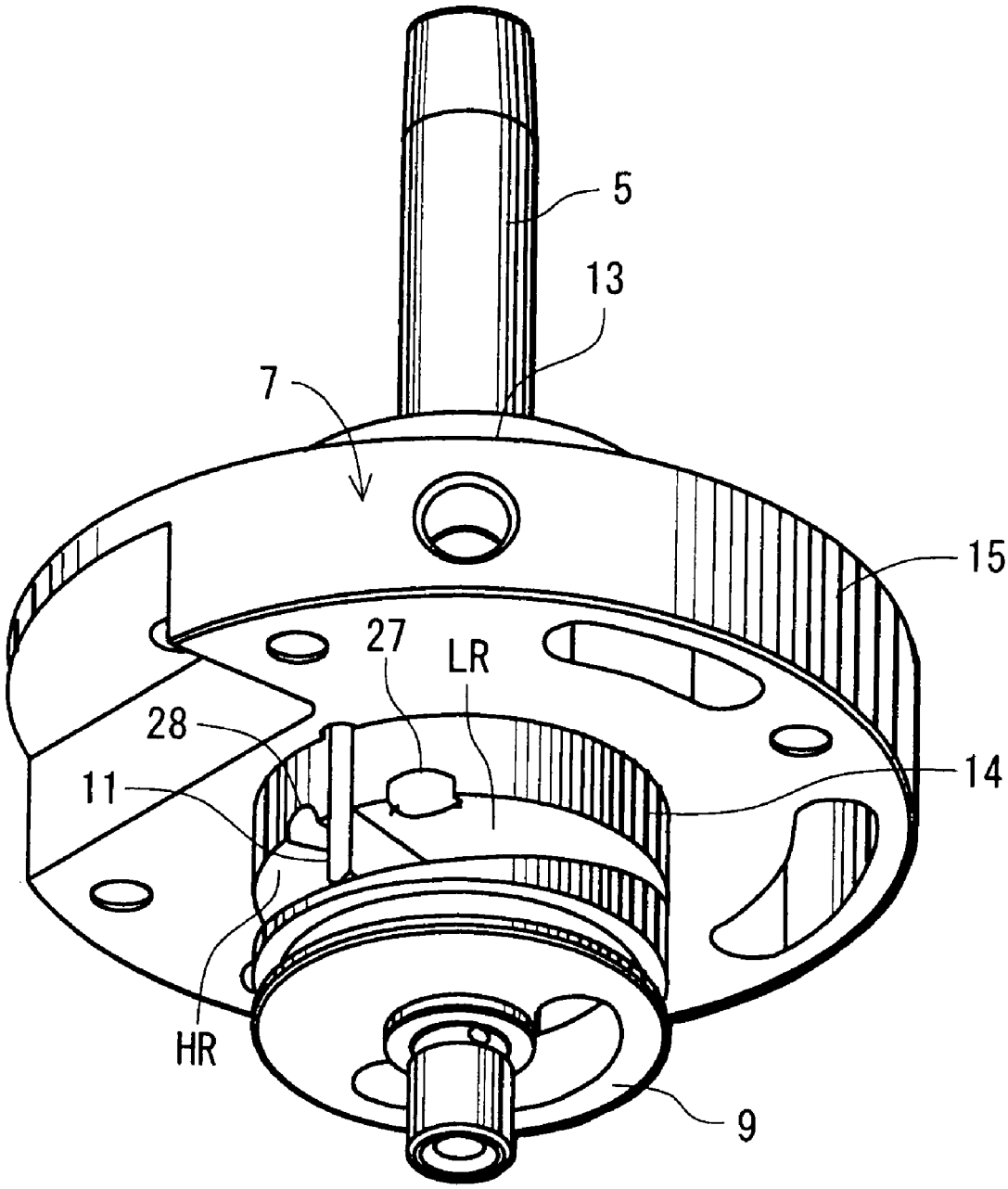
FIG. 3 is a perspective view showing a compression element of the compressor of FIG. 1.
Figure 4:
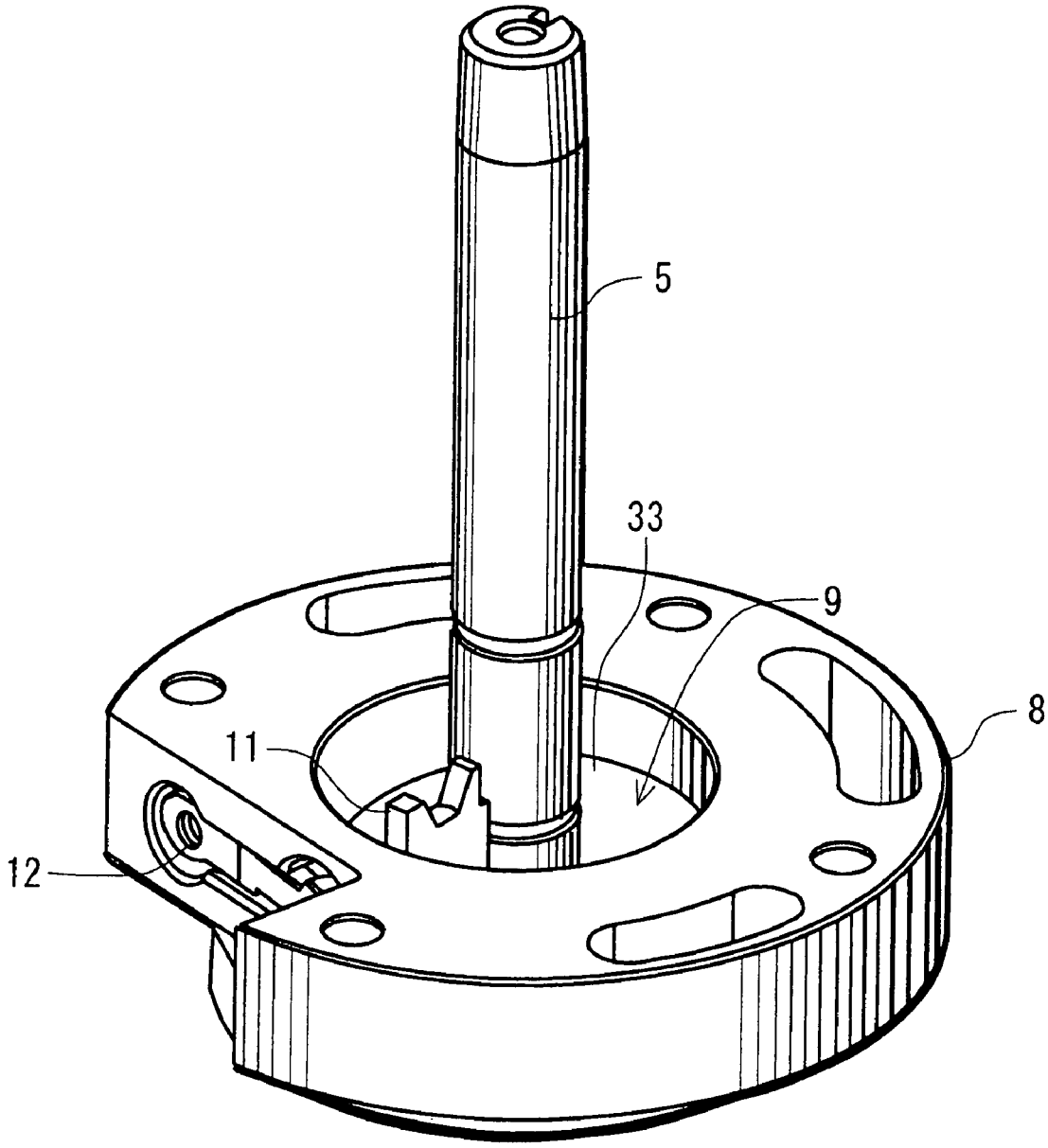
FIG. 4 is another perspective view of the compression element of the compressor of FIG. 1.
Figure 5:
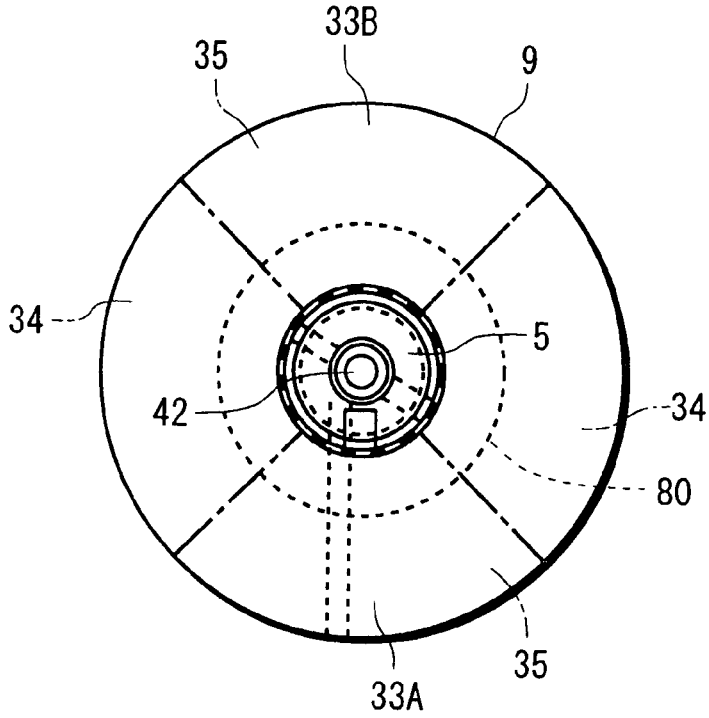
FIG. 5 is a plan view showing the compression element of the compressor of FIG. 1.
Figure 6:
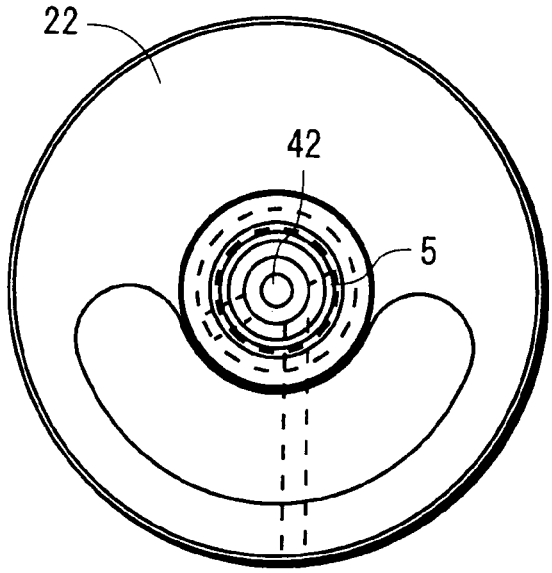
FIG. 6 is a bottom plan view of the compression element of the compressor of FIG. 1.

FIG. 1 is a vertical sectional side view showing the compressor C according to a first embodiment of the present invention, FIG. 2 is another vertical sectional side view, FIG. 3 is a perspective view of a compression element 3 of the compressor C, FIG. 4 is another perspective view of the compression element 3 of the compressor C, FIG. 5 is a plan view of the compression element 3 of the compressor C, and FIG. 6 is a bottom plan view of the compression element 3 of the compressor C, respectively. Throughout the drawings, a reference numeral 1 denotes a sealed container which receives a driving element 2 on its upper side and the compression element 3 driven by a rotary shaft 5 of the driving element 2 on its lower side.

The driving element 2 is an electric motor which is fixed to an inner wall of the sealed container 1 and which comprises a stator 4 having a stator coil wound therearound and a rotor 6 having a rotary shaft 5 in a center inside the stator 4. Incidentally, a clearance 10 is formed between an outer peripheral part of the stator 4 of the driving element 2 and the sealed container 1 to allow upper and lower sides to communicate with each other.

The compression element 3 comprises: a support member 7 fixed to the inner wall of the sealed container 1; a cylinder 8 attached to a bottom surface of the support member 7 by bolts; a compression member 9, a vane 11, and a discharge valve 12 arranged in the cylinder 8 as described later; a sub-support member 22 attached to an underside of the cylinder 8 via bolts and the like. An upper surface central portion of the support member 7 concentrically projects upward, and a main bearing 13 of the rotary shaft 5 is formed therein. A columnar projected part 14 is concentrically fixed to a bottom surface central portion via bolts, and a bottom surface 14A of the projected part 14 is a smooth surface. That is, the support member 7 comprises: a main member 15 fixed to the inner wall of the sealed container 1; the main bearing 13 which protrudes upwards from the main member 15; and the projected part 14 fixed to a lower part of the main member 15 via the bolts.

A slot 16 is formed in the projected part 14 of the support member 7, and the vane 11 is inserted into this slot 16 to reciprocate up and down. A back pressure chamber 17 is formed in an upper part of the slot 16 to apply a high pressure of the sealed container 1 as a back pressure to the vane 11. A coil spring 18 is arranged as urging means in the slot 16 to urge an upper surface of the vane 11 downward.

Moreover, an upper opening of the cylinder 8 is closed by the support member 7, and accordingly a compression space 21 is constituted inside the cylinder 8 (the inside of the cylinder 8 between the compression member 9 and the projected part 14 of the support member 7). A suction passage 24 is formed in the cylinder 8, and a suction pipe 26 is attached to the sealed container 1 to be connected to the suction passage 24. A suction port 27 and a discharge port 28 are formed in the cylinder 8 to communicate with the compression space 21. The suction passage 24 communicates with the suction port 27, and the discharge port 28 communicates with the inside of the sealed container 1 on a side face of the cylinder 8. Additionally, the vane 11 is positioned between the suction port 27 and the discharge port 28.

The rotary shaft 5 is rotatably supported by the main bearing 13 formed on the support member 7, and a sub-bearing 23 formed in the sub-support member 22. That is, the rotary shaft 5 is inserted into the centers of the support member 7, the cylinder 8, and the sub-support member 22, its center of an up-and-down direction is rotatably supported by the main bearing 13, and its lower end is rotatably supported by the sub-bearing 23 of the sub-bearing 22. The compression member 9 is integrally formed in a lower part of the rotary shaft 5, and disposed in the cylinder 8.

Figure 7:
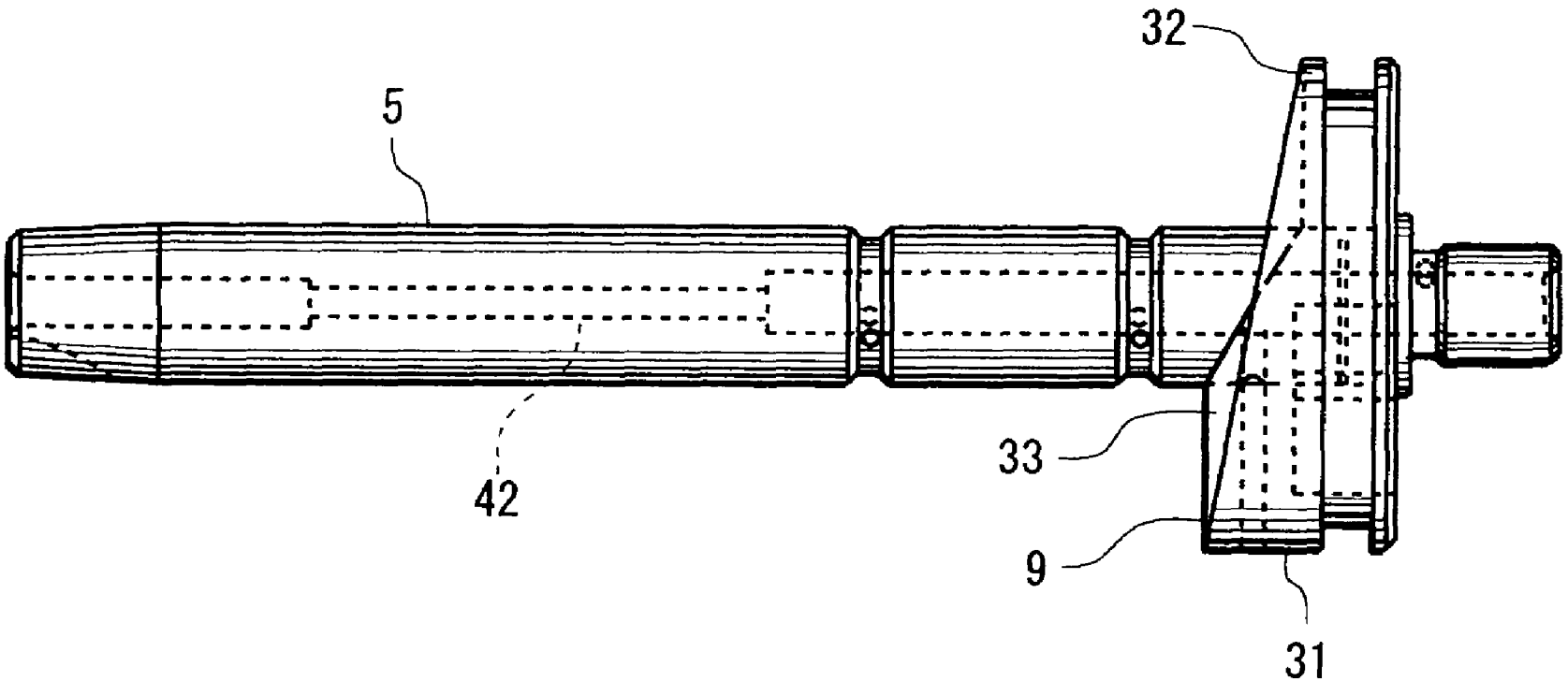
FIG. 7 is side view of a rotary shaft including a compression member of the compressor of FIG. 1.
Figure 8:
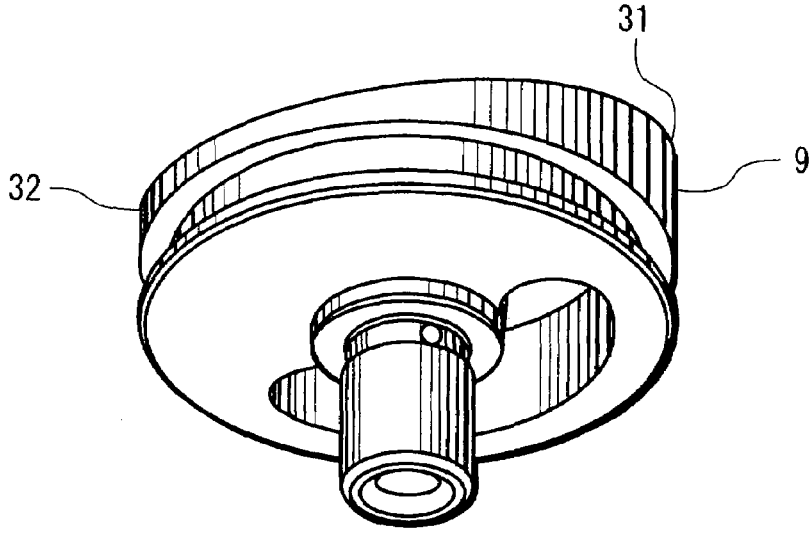
FIG. 8 is a first perspective view showing the compression member of the compressor of FIG. 1.
Figure 9:
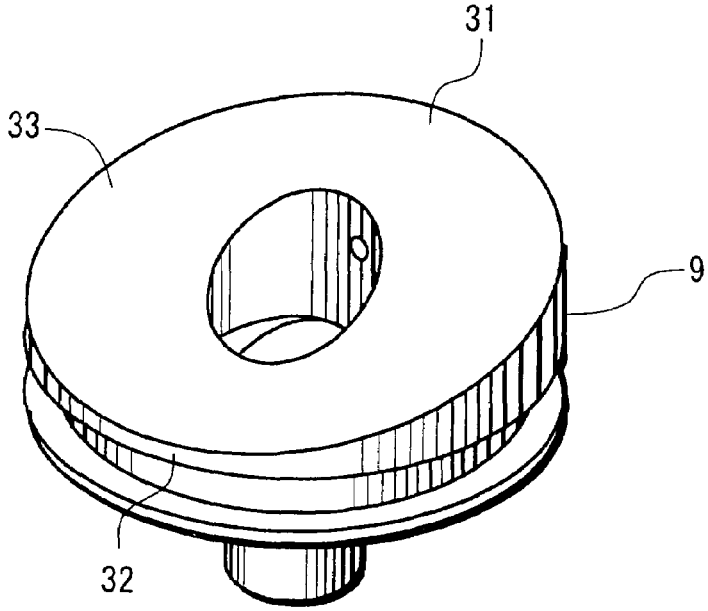
FIG. 9 is a second perspective view showing the compression member of the compressor of FIG. 1.
Figure 10:
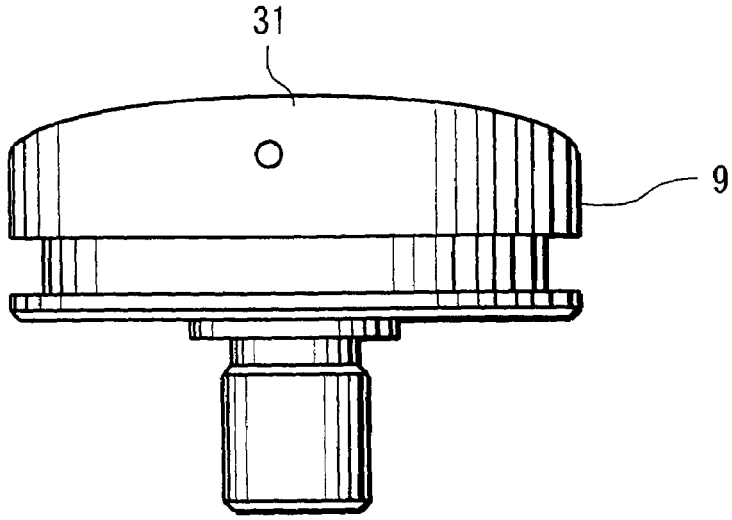
FIG. 10 is a third perspective view showing the compression member of the compressor of FIG. 1.
Figure 11:
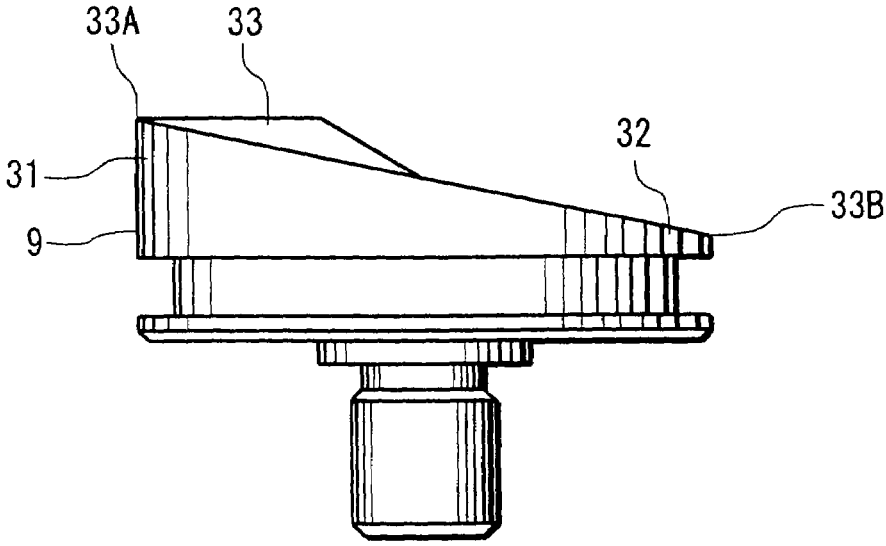
FIG. 11 is a fourth perspective view showing the compression member of the compressor of FIG. 1.
Figure 12:
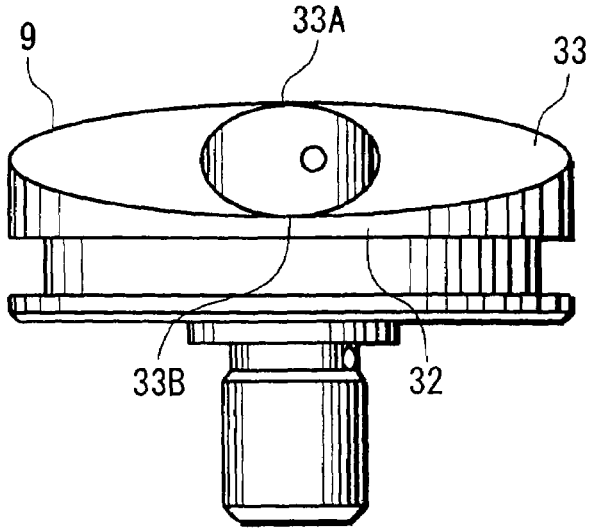
FIG. 12 is a fifth perspective view showing the compression member of the compressor of FIG. 1.
Figure 13:
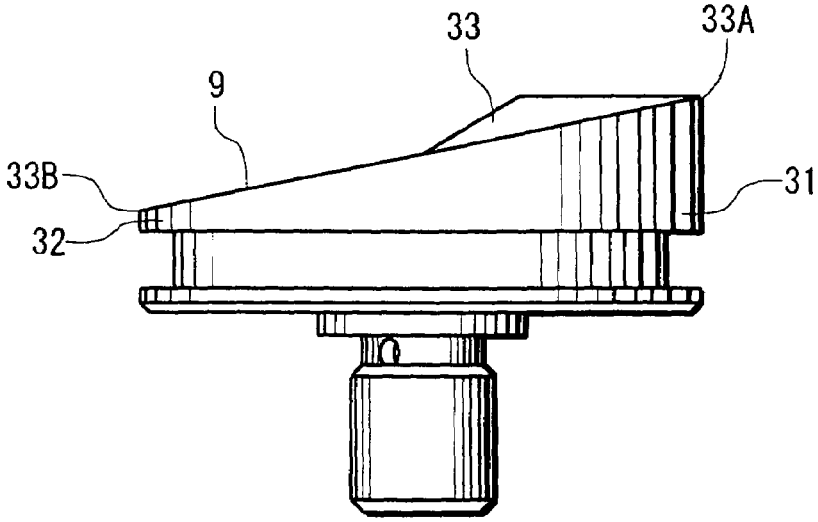
FIG. 13 is a sixth perspective view showing the compression member of the compressor of FIG. 1.

The compression member 9 is disposed in the cylinder 8 as described above, and rotated by the rotary shaft 5 to compress a fluid (refrigerant in the present embodiment) sucked from the suction port 27 and discharge the fluid from the discharge port 28 into the sealed container 1. The compression member exhibits a roughly cylindrical shape concentric to the rotary shaft 5 as a whole. FIG. 7 is a side view of the rotary shaft 5 including the compression member 9 of the compressor C, and FIGS. 8 to 13 show perspective views of the compression member 9, respectively. As shown in FIGS. 7 to 13, the compression member 9 exhibits a shape in which a thick part 31 on one side and a thin part 32 on the other side are continuous, and an upper surface 33 (one surface) thereof crossing an axial direction of the rotary shaft 5 is a slope in which the thick part 31 is high and the thin part 32 is low. That is, the upper surface 33 exhibits an inclined shape which extends from a highest top dead center 33A to a lowest bottom dead center 33B and returns to the top dead center 33A and which is continuous between the top dead center 33A and the bottom dead center 33B.

The upper surface 33 of the compression member 9 comprises: first curved surfaces 34, 34 constituted in a predetermined region centering on an intermediate point 33C between the top dead center 33A and the bottom dead center 33B; and second curved surfaces 35, 35 which connect the respective first curved surfaces 34, 34 to each other via the top dead center 33A and the bottom dead center 33B.

Figure 14:
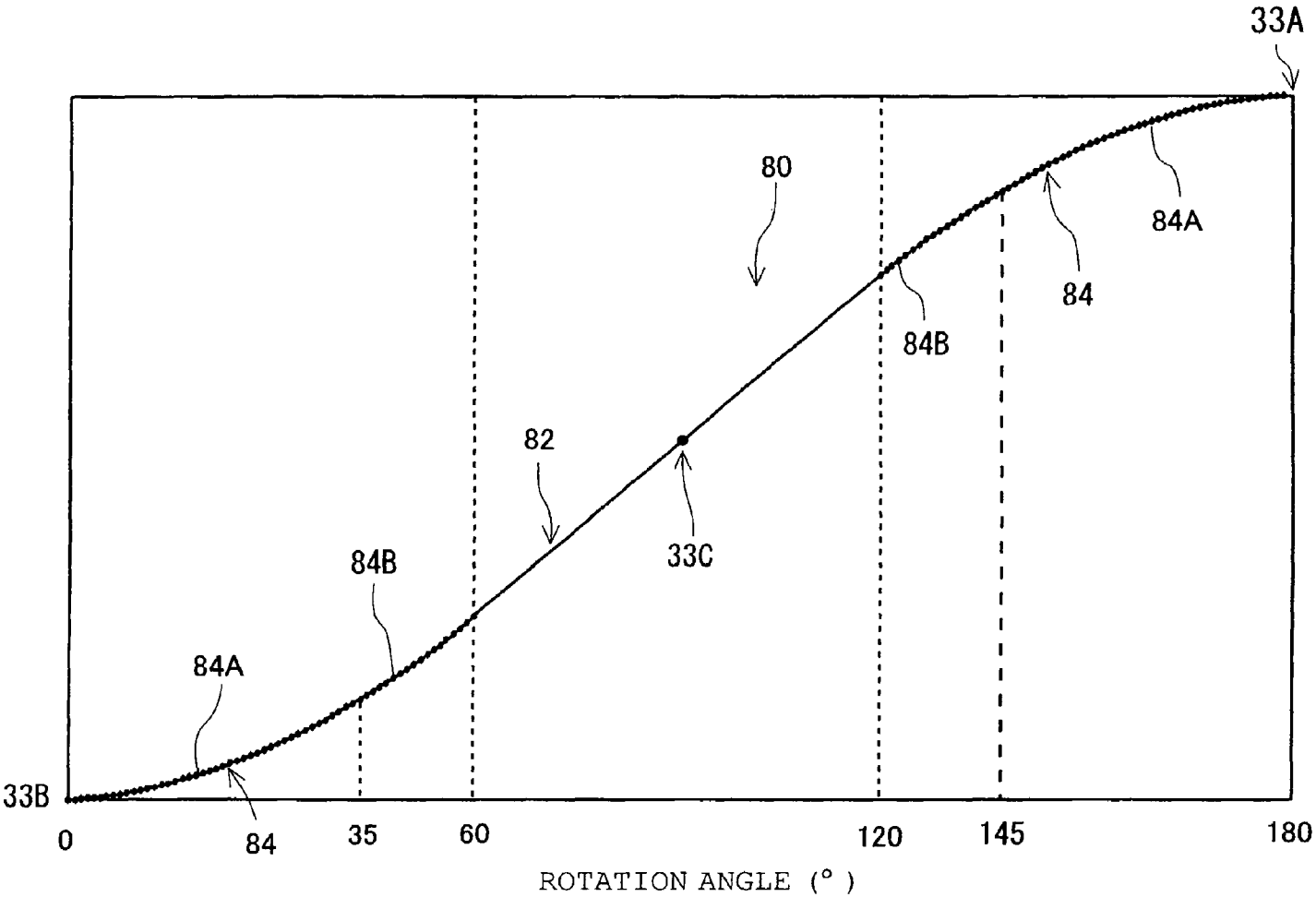
FIG. 14 is an enlarged view showing inclination in a case where an upper surface of the compression member of the compressor of FIG. 1 is viewed from a side surface.

Here, a shape of the upper surface 33 of the compression member 9 will be described. FIG. 14 is a diagram in which a line from the top dead center 33A to the bottom dead center 33B is developed in a line 80 connecting points having an equal distance from the center of the rotary shaft 5. As shown in FIG. 14, as to the line 80 which connects the points having the equal distance from the center of the rotary shaft 5, a straight line 82 is formed in the first curved surface 34, and a curve 84 is asymptotically formed with respect to the top dead center 33A and the bottom dead center 33B in the second curved surface 35. The line 80 connecting the points having the equal distance from the center of the rotary shaft 5 inclines steeply when the distance from the center of the rotary shaft 5 shortens, and inclines moderately when the distance lengthens. The upper surface 33 of the compression member 9 comprises a group of these lines 80.

The curve 84 exhibits sine wave shapes (curves 84A) in the vicinities of the top dead center 33A and the bottom dead center 33B, and curves 84B smoothly connect the straight line 82 to the curves of the sine wave shape in the vicinity of a connection point to the straight line 82. That is, assuming that the bottom dead center 33B has a rotation angle of 0°, the upper surface of the compression member 9 of the present embodiment comprises: curved surfaces constituted of the curves 84A having the sine wave shapes in a range of 325° to 35° and a symmetric range of 145° to 215°; the first curved surfaces 34 constituted of the straight line 82 in a range of 60° to 120° and a symmetric range of 240° to 300°; and curved surfaces connecting these surfaces and each constituted of the curve 84A having the sine wave shape and the straight line 82 in ranges of 35° to 60°, 120° to 145°, 215° to 240°, and 300° to 325°. It is to be noted that the upper surface 33 of the compression member 9 of the present embodiment is constituted of: the curved surfaces comprising the curves 84A having the sine wave shape in the ranges of 325° to 35° and 145° to 215°; and the first curved surfaces 34 constituted of the straight line 82 in the ranges of 60° to 120° and 240° to 300°. However, the present invention is not limited to the ranges of the rotation angles, and the upper surface 33 of the compression member 9 may comprise: the first curved surface in a predetermined range centering on the intermediate point 33C between the top dead center 33A and the bottom dead center 33B; and the second curved surface which connects the respective first curved surfaces 34, 34 to each other via the top dead center 33A and the bottom dead center 33B.

Moreover, the inclination of the first curved surface is steeper that that in a case where the line 80 is a straight line in a whole region between the top dead center 33A and the bottom dead center 33B, and the inclination is more moderate than that of the intermediate point in a case where the line 80 is a curve having the sine wave shape in the whole region between the top dead center 33A and the bottom dead center 33B.

The first curved surface 34 is constituted in such a manner that the line 80 connecting the points having the equal distance from the center of the rotary shaft 5 is the straight line in this manner. Consequently, the upper surface 33 of the compression member 9 can be easily worked, and costs can be reduced. The inclination of the first curved surface 34 is set to be steeper than that in a case where the line 80 is the straight line in the whole region between the top dead center 33A and the bottom dead center 33B. Accordingly, the vane 11 can be smoothly moved in the vicinities of the top dead center 33A and the bottom dead center 33B. Furthermore, the inclination is set to be more moderate than that of the intermediate point in a case where the curved line having the sine wave shape is formed in the whole region between the top dead center 33A and the bottom dead center 33B, and accordingly sliding losses by the vane 11 can be reduced. Consequently, a performance of the compressor C can be improved, and highly efficient compression can be realized.

Furthermore, the top dead center 33A of the compression member 9 movably faces the bottom surface 14A of the projected part 14 of the support member 7 through a very small clearance. The vane 11 is disposed between the suction port 27 and the discharge port 28 as described above. Incidentally, the vane abuts on the upper surface 33 of the compression member 9 to partition the compression space 21 of the cylinder 8 into a low pressure chamber LR and a high presser chamber HR. The coil spring 18 always urges the vane 11 to the upper surface 33 side.

Figure 15:
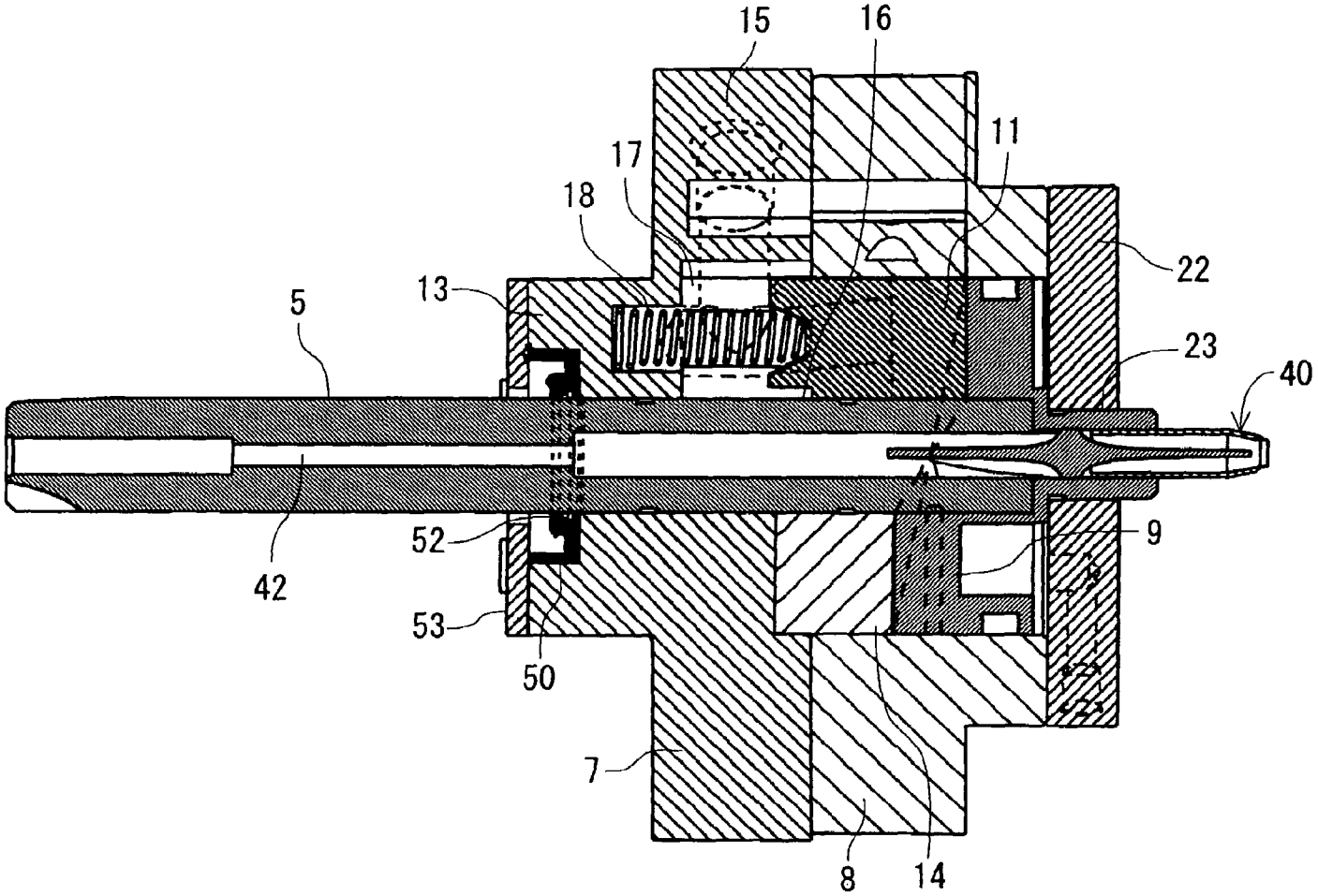
FIG. 15 is a vertical sectional side view showing the rotary shaft and the compression member of the compressor of FIG. 1.
Figure 16:
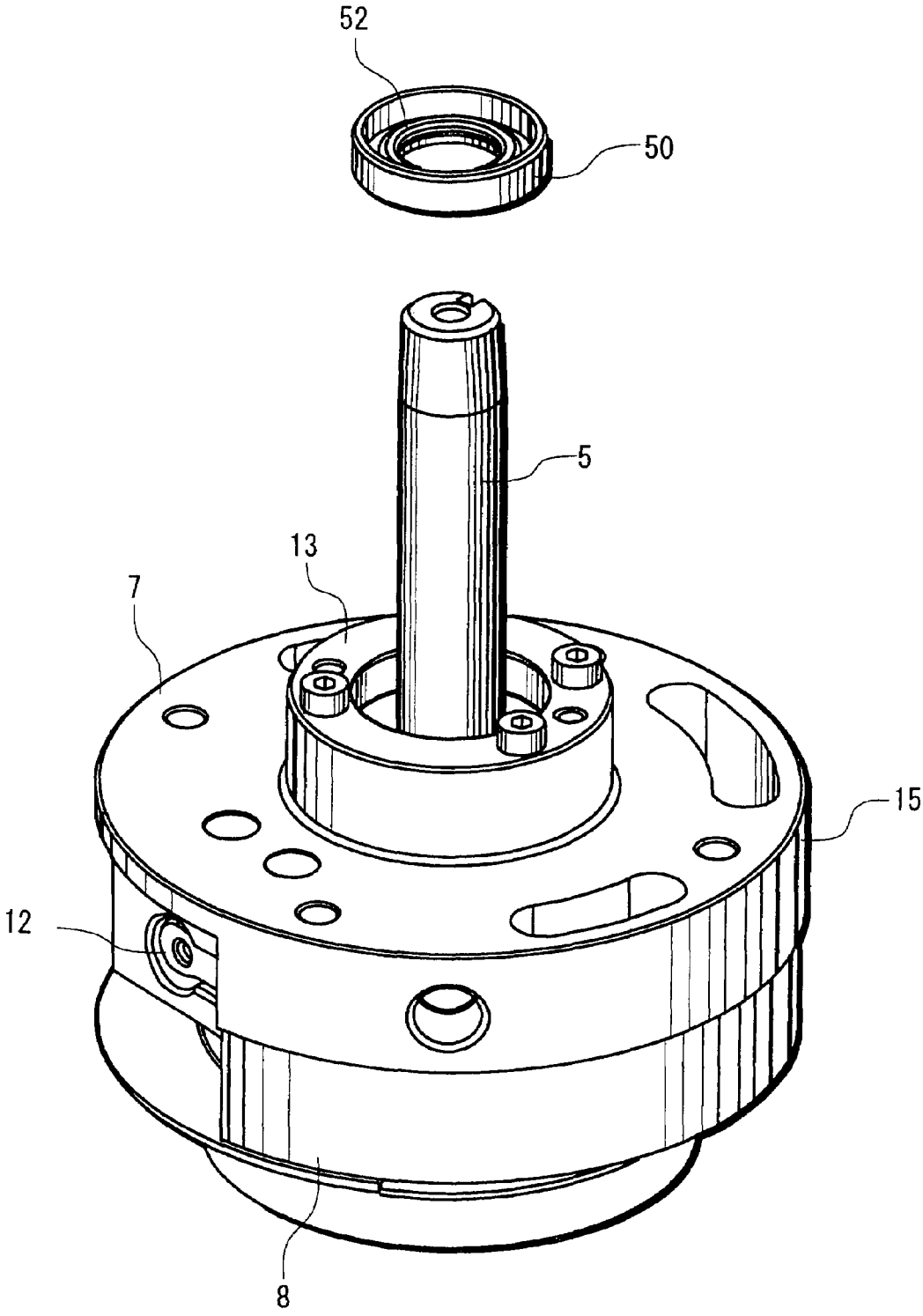
FIG. 16 is a perspective view of the rotary shaft in a state in which a cylinder of FIG. 15 is attached.
Figure 17:
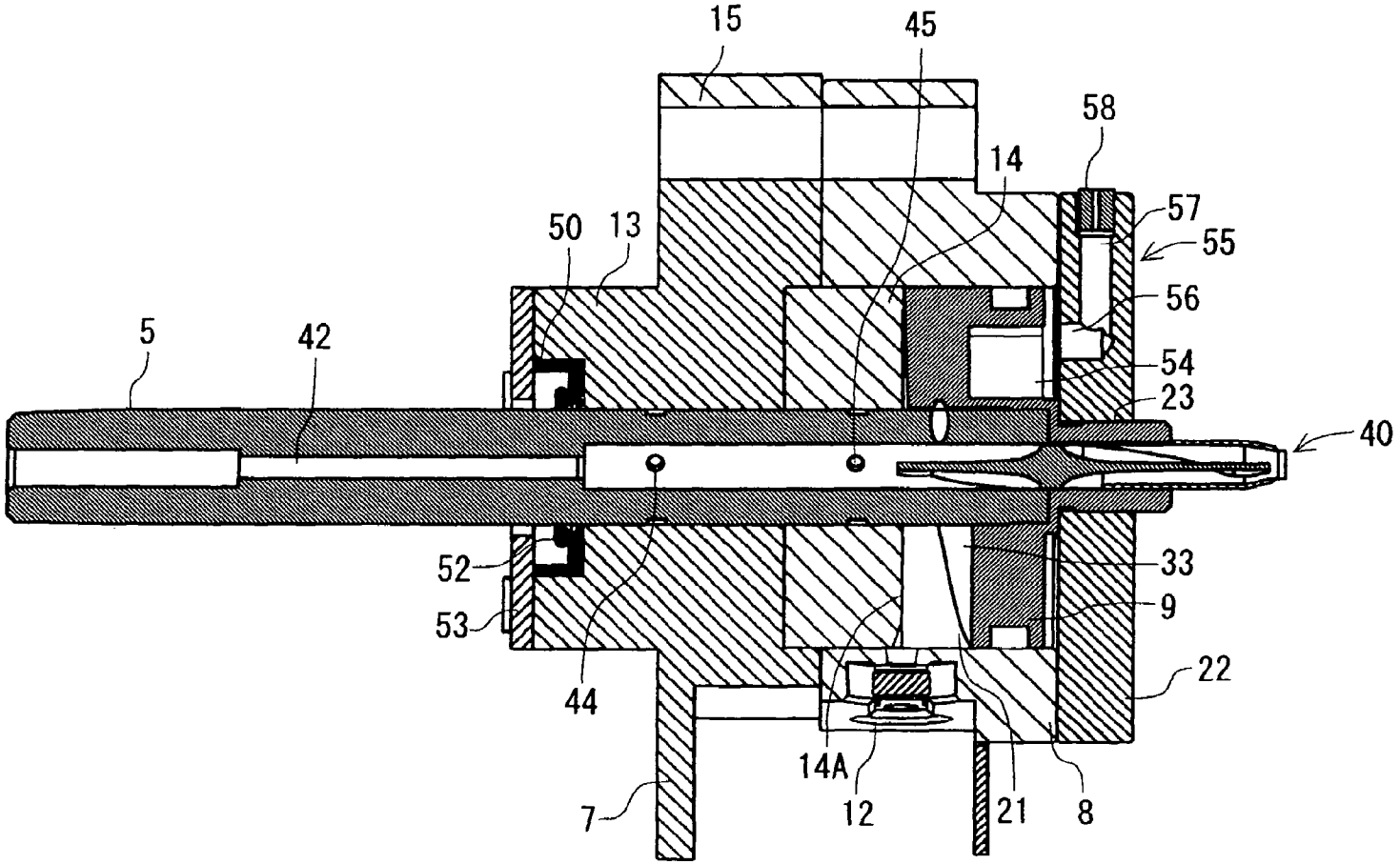
FIG. 17 is another vertical sectional side view showing the compression element of the compressor of FIG.

On the other hand, as shown in FIGS. 15 to 17, there is disposed a bearing on a side opposite to the compression member 9 with respect to the sub-bearing 23 on a lower-surface (the other surface) side of the compression member 9, that is, the bearing on the upper surface 33 side of the compression member 9. On an end portion of this main bearing 13, a shaft seal 50 which abuts on the rotary shaft 5 is disposed. This shaft seal 50 comprises: a support portion formed by coating an iron plate with a rubber member such as an NBR material; and an abutment portion 52 which abuts on the rotary shaft 5 and which is disposed in such a manner as to seal a gap formed between the rotary shaft 5 and the support member 7. The abutment portion 52 is provided with a spring member for inward (rotary shaft 5) urging, and the member slidably abuts on the rotary shaft 5. An upper surface of the shaft seal 50 is closed by a cover 53, and this prevents falling of the shaft seal 50 (FIGS. 1 and 2 do not show the shaft seal 50 or the cover 53) It is to be noted that the cover 53 is fixed to the upper surface of the support member 7 via bolts. Since the shaft seal 50 seals the main bearing 13 side, the inner surface of the main bearing 13 achieves sufficient sealing, and gas leakage can be prevented. Since it is possible to avoid in advance a disadvantage that the refrigerant gas in the compression space 21 leaks from the clearance of the main bearing 13 between the rotary shaft 5 and the support member 7, a volume efficiency can be improved. Consequently, a performance of the compressor C can be enhanced.

A lower opening of the cylinder 8 is closed by the sub-support member 22, and a space 54 is formed between the lower surface (the other surface) of the compression member 9 and the sub-support member 22 (on a back-surface side of the compression space 21). This space 54 communicates with the inside of the sealed container 1 via pressure adjustment means 55. This pressure adjustment means 55 is formed in an axial center direction in the sub-support member 22, and comprises: a hole 56 which communicates with the lower surface of the compression member 9; a communication hole 57 whose one end communicates with the hole 56 and which extends outwards from the hole 56 in a horizontal direction (sealed container 1 side) in the sub-support member 22 and whose other end communicates with the inside of the sealed container 1; and a nozzle member 58 inserted into the other end (end portion communicating with the inside of the sealed container 1) of the communication hole 57 to form a micro passage (nozzle) in a central portion thereof (FIG. 17).

The refrigerant in the sealed container 1 flows into the space 54 by the pressure adjustment means 55. That is, a high-pressure refrigerant in the sealed container 1 flows from the nozzle member 58 of the pressure adjustment means 55 into the space 54 via the communication hole 57 and the hole 56. In this case, into the space 54, there flows the refrigerant whose pressure has dropped by passage resistance of the micro passage while flowing through the micro passage formed in the nozzle member 58. Accordingly, the pressure in the space 54 on the lower surface side (other surface side) of the compression member 9 indicates a value which is lower than that of the pressure in the sealed container 1.

Here, in a case where the space 54 is provided with a high pressure, the compression member 9 is strongly pressed toward the support member 7 by the pressure of the space 54, and a friction is generated between the bottom surface 14A of the projected part 14 which is a receiving surface, and the top dead center 33A of the upper surface 33 of the compression member 9. Since these surfaces are remarkably worn, durability is much deteriorated. However, when the pressure of the space 54 is set to a value lower than that of the high pressure in the sealed container 1 by the pressure adjustment means 55 as in the present invention, it is possible to reduce a force by which the top dead center 33A of the upper surface 33 of the compression member 9 is pushed toward the bottom surface 14A of the projected part 14 constituting the receiving surface. Alternatively, the bottom surface 14A of the projected part 14 has a small clearance from the top dead center 33A of the upper surface 33 of the compression member 9 without being brought into contact with the center. Consequently, the durability of the upper surface 33 of the compression member 9 is improved, and enhancement of reliability and reduction of mechanical losses can be achieved.

It is to be noted that the clearance between the top dead center 33A of the compression member 9 and the bottom surface 14A of the projected part 14 of the support member 7 is sealed by oil introduced in the sealed container 1, so that the gas leakage can be avoided, and highly efficient running can be maintained.

On the other hand, hardness of the upper surface 33 (one surface) of the compression member 9 is set to be higher than that of the bottom surface 14A of the projected part 14 of the support member 7, which is the receiving surface of the top dead center 33A. Here, FIG. 18 shows one example of materials and working methods of members for use in the upper surface 33 of the compression member 9 and the vane 11. As shown in FIG. 18, in a case where a nitrided high-speed tool steel-based material (SKH) is used as the vane 11, in the rotary shaft 5 and the upper surface 33 of the compression member 9, there is used: a material constituted by cemented quenching of the surface of chrome molybdenum steel (SCM) or carbon steel (e.g., S45C, etc.); a material constituted by high-frequency quenching of chrome molybdenum steel or carbon steel; grey cast iron (FC); or spherical graphite cast iron (FCD). In this case, the hardness of the upper surface 33 (one surface) of the compression member 9 is lower than that of the vane 11.

Moreover, in a case where the high-speed tool steel-based material subjected to a PVD treatment is used as the vane 11, in the rotary shaft 5 and the upper surface 33 of the compression member 9, there is used: grey cast iron or spherical graphite cast iron subjected to the nitriding or quenching treatment in addition to: the material constituted by the cemented quenching of the surface of chrome molybdenum steel or carbon steel; the material constituted by the high-frequency quenching of chrome molybdenum steel or carbon steel; grey cast iron; or spherical graphite cast iron. Also in this case, the hardness of the upper surface 33 (one surface) of the compression member 9 is lower than that of the vane 11 as described above.

Since the hardness of the upper surface 33 of the compression member 9 is set to be lower than that of the vane 11 in this manner, the vane 11 is not easily worn. Consequently, the durability of the vane 11 can be enhanced.

Moreover, the hardness of the upper surface 33 of the compression member 9 is set to be higher than that of the bottom surface 14A of the projected part 14 as the receiving surface of the top dead center 33A of the compression member 9. Accordingly, even in a case where the top dead center 33A abuts on the bottom surface 14A of the projected part 14, the upper surface 33 of the compression member 9 is not easily worn, and the durability of the compression member 9 can be improved.

Here, in a case where the compression element 3 is not lubricated with oil such as lubricant, a hardness difference is made between the vane 11 and the upper surface 33 (one surface) of the compression member 9. That is, in a case where the vane 11 is constituted of a carbon-based material as shown in FIG. 18, as the rotary shaft 5 and the upper surface 33 of the compression member 9, there is used: the material constituted by the cemented quenching of the surface of chrome molybdenum steel or carbon steel; the material constituted by the high-frequency quenching of chrome molybdenum steel or carbon steel; or grey cast iron or spherical graphite cast iron subjected to the nitriding or quenching treatment. In this case, these sliding portions can be slid without being lubricated with the oil or the like. Also in this case, the hardness of the upper surface 33 (one surface) of the compression member 9 is lower than that of the vane 11.

Similarly, in a case where the vane 11 is constituted of a ceramic-based material, as the rotary shaft 5 and the upper surface 33 of the compression member 9, there is used: the same ceramic-based material as that of the vane 11; the material constituted by the cemented quenching of the surface of chrome molybdenum steel or carbon steel; the material constituted by the high-frequency quenching of chrome molybdenum steel or carbon steel; or grey cast iron or spherical graphite cast iron subjected to the nitriding or quenching treatment. Also in this case, the sliding portions can be slid without being lubricated with the oil or the like. Also in this case, the hardness of the upper surface 33 (one surface) of the compression member 9 is lower than that of the vane 11.

Furthermore, in a case where the vane 11 is constituted of a fluorine resin-based material or a polymer material such as a polyether ether ketone (PEEK)-based material, as the rotary shaft 5 and the upper surface 33 of the compression member 9, there is used: a material constituted by subjecting aluminum (Al) to a surface treatment (alumite treatment); the material constituted by the cemented quenching of the surface of chrome molybdenum steel or carbon steel; the material constituted by the high-frequency quenching of chrome molybdenum steel or carbon steel; or grey cast iron or spherical graphite cast iron subjected to the nitriding or quenching treatment. In this case, the sliding portions can be slid without being lubricated with the oil or the like as described above. In this case, the hardness of the upper surface 33 of the compression member 9 is higher than that of the vane 11.

As described above, when the vane 11 is constituted of the carbon-based material, the ceramic-based material, the fluorine resin-based material, or polyether ether ketone, the material and the working shown in FIG. 18 are used in the upper surface 33 of the compression member 9, respectively. In this case, when the vane 11 is constituted of the carbon-based material or the ceramic-based material, the hardness of the upper surface 33 of the compression member 9 is lower than that of the vane 11. When the vane is constituted of the fluorine resin-based material or polyether ether ketone, the hardness of the upper surface 33 of the compression member 9 is higher than that of the vane 11.

In this manner, the vane 11 is constituted of the carbon-based material, the ceramic-based material, the fluorine resin-based material, or polyether ether ketone, and is constituted in such a manner as to make a hardness difference between the upper surface 33 of the compression member 9 and the vane 11. Consequently, resistances to wears of the compression member 9 and the vane 11 are enhanced, and the durability can be enhanced.

Furthermore, when the hardness of the upper surface 33 of the compression member 9 is set to be higher than that of the bottom surface 14A of the projected part 14 as the receiving surface of the top dead center 33A of the compression member 9, the upper surface 33 of the compression member 9 is not easily worn even in a case where the top dead center 33A abuts on the bottom surface 14A of the projected part 14. The durability of the compression member 9 can be enhanced.

Especially, when the vane 11 is constituted of the above-described carbon-based material, the ceramic-based material, the fluorine resin-based material, or polyether ether ketone, satisfactory slidability can be retained even in a case where oil is insufficiently supplied to sliding portions such as the vane 11 and the compression member 9. That is, the sliding portions of the compression element 3 can be formed to be non-lubricated without being lubricated with oil or the like. Consequently, the present invention can be applied to a compressor with a non-lubricated specification, and versatility can be enhanced.

A very small clearance is formed between a peripheral side face of the compression member 9 and an inner wall of the cylinder 8, whereby the compression member 9 freely rotates. The clearance between the peripheral side face of the compression member 9 and the inner wall of the cylinder 8 is also sealed with oil.

The discharge valve 12 is mounted to an outer side of the discharge port 28 to be positioned in a side face of the compression space 21 of the cylinder 8, and a discharge pipe 37 is mounted to an upper end of the sealed container 1. An oil reservoir 36 is formed in a bottom part in the sealed container 1. An oil pump 40 is disposed on a lower end of the rotary shaft 5, and one end of the pump is immersed in the oil reservoir 36. Moreover, the oil pumped up by the oil pump 40 is supplied to the sliding portion or the like of the compression element 3 via an oil passage 42 formed in the center of the rotary shaft 5 and oil holes 44, 45 formed ranging from the oil passage 42 to the side surface of the compression element 3 in the axial direction of the rotary shaft 5. In the sealed container 1, a predetermined amount of carbon dioxide ($CO_2$), R-134a, or HC-based refrigerant is sealed in.

According to the aforementioned constitution, when power is supplied to the stator coil of the stator 4 of the driving element 2, the rotor 6 is rotated clockwise (seen from the bottom). The rotation of the rotor 6 is transmitted through the rotary shaft 5 to the compression member 9, whereby the compression member 9 is rotated clockwise in the cylinder 8 (seen from the bottom). Now, it is assumed that the top dead center 33A of the upper surface 33 of the compression member 9 is on the vane 11 side of the discharge port 28, and the refrigerant in a refrigerant circuit is sucked from the suction port 27 through the suction pipe 26 and the suction passage 24 into a space (low pressure chamber LR) surrounded with the cylinder 8, the support member 7, the compression member 9 and the vane 11 on the suction port 27 side of the vane 11.

Moreover, when the compression member 9 is rotated in this state, a volume of the space is narrowed due to inclination of the upper surface 33 from a stage at which the top dead center 33A passes through the vane 11 and the suction port 27, and the refrigerant in a space (high pressure chamber HR) is compressed. Then, the refrigerant compressed until the top dead center 33A passes through the discharge port 28 is continuously discharged from the discharge port 28. On the other hand, after the passage of the top dead center 33A through the suction port 27, the volume of the space (low pressure chamber LR) surrounded with the cylinder 8, the support member 7, the compression member 9 and the vane 11 on the suction port 27 side of the vane 11 is expanded. Accordingly, the refrigerant is sucked from the refrigerant circuit through the suction pipe 26, the suction passage 24, and the suction port 27 into the compression space 21.

The refrigerant is discharged from the discharge port 28 through the discharge valve 12 into the sealed container 1. Then, the high-pressure refrigerant discharged into the sealed container 1 passes through an air gap between the stator 4 and the rotor 6 of the driving element 2, separated from the oil in the upper part (above driving element 2) in the sealed container 1, and discharged through the discharge pipe 37 into the refrigerant circuit. On the other hand, the separated oil flows down through the clearance 10 formed between the sealed container 1 and the stator 4 to return into the oil reservoir 36.

According to such a constitution, though the compressor C is compact and simple in structure, the compressor can exhibit a sufficient compression function. Especially, since the conventional adjacent arrangement of high and low pressures in the entire region of the cylinder 8 is eliminated, and the compression member 9 has the continuous thick and thin parts 31 and 32 and exhibits a shape in which the upper surface 33 (one surface) is inclined, a sufficient sealing size can be secured between the thick part 31 which corresponds to the high pressure chamber HR and the inner wall of the cylinder 8.

Thus, the occurrence of refrigerant leakage between the compression member 9 and the cylinder 8 can be effectively prevented to enable efficient running. Furthermore, since the thick part 31 of the compression member 9 plays a role of a flywheel, torque fluctuation is reduced. Since the compressor C is a so-called internal high-pressure type compressor, the structure can be simplified more.

Moreover, since the slot 16 of the vane 11 is formed in the support member 7 (projected part 14 of the support member 7), and the coil spring 18 is disposed in the support member 7, it is not necessary to form a vane mounting structure in the cylinder 8 which necessitates accuracy, and thus workability can be improved. Furthermore, by forming the compression member 9 integrally with the rotary shaft 5 as in the embodiment, the number of components can be reduced more.

It is to be noted that in the present embodiment, the space 54 communicates with the inside of the sealed container 1 via the pressure adjustment means 55 comprising: the hole 56 formed in the axial center direction in the sub-support member 22 to communicate with the lower surface of the compression member 9; the communication hole 57 which extends outwards from the hole 56 in the horizontal direction in the sub-support member 22 and whose other end communicates with the inside of the sealed container 1; and the nozzle member 58 inserted into the other end of the communication hole 57 to form the micro passage (nozzle) in the central portion thereof. The high-pressure refrigerant in the sealed container 1 is passed through the micro passage formed in the nozzle member 58. Accordingly, the pressure is lowered, and the pressure in the space 54 on a lower surface side of the compression member 9 is set to be lower than that in the sealed container 1. The present invention is not limited to this embodiment. As to the pressure adjustment means, for example, the space 54 is allowed to communicate with the inside of the sealed container 1 via a hole extended through the sub-support member 22 in the axial center direction, and a nozzle member in which a micro passage (nozzle) is formed centering on an opening on the sealed container 1 side may be inserted into the hole.

Second Embodiment

It is to be noted that in the first embodiment, the shaft seal 50 is disposed in the end portion of the main bearing 13 which is the bearing on the side opposite to the compression member 9 in such a manner as to avoid in advance the disadvantage that the refrigerant gas in the compression space 21 leaks from the clearance of the main bearing 13 between the rotary shaft 5 and the support member 7. However, the present invention is not limited to this embodiment, and a piston ring seal may be disposed in the rotary shaft 5 in a position corresponding to the bearing.

Figure 19:
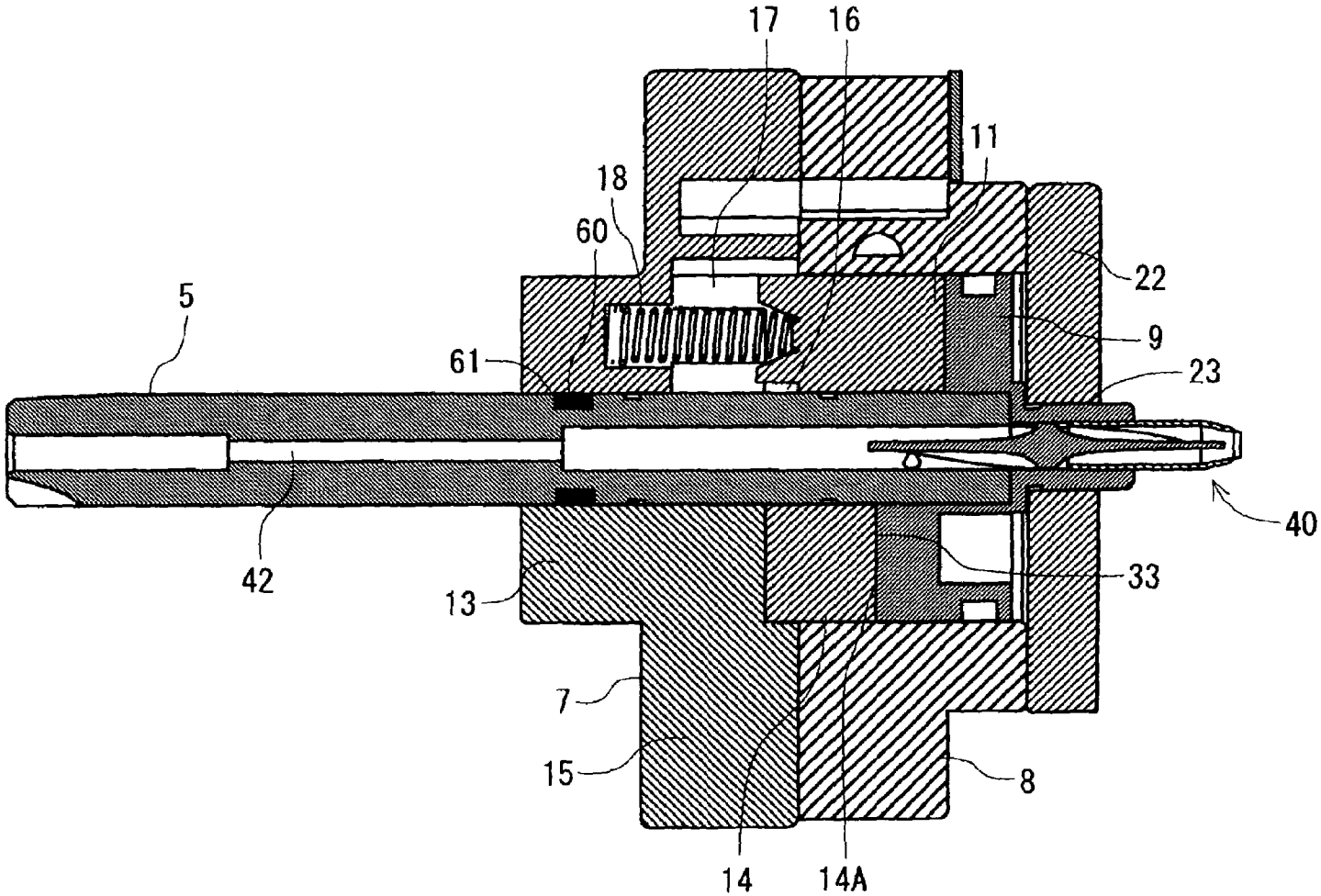
FIG. 19 is a vertical sectional side view showing the compression element of the compressor according to a second embodiment of the present invention.
Figure 20:
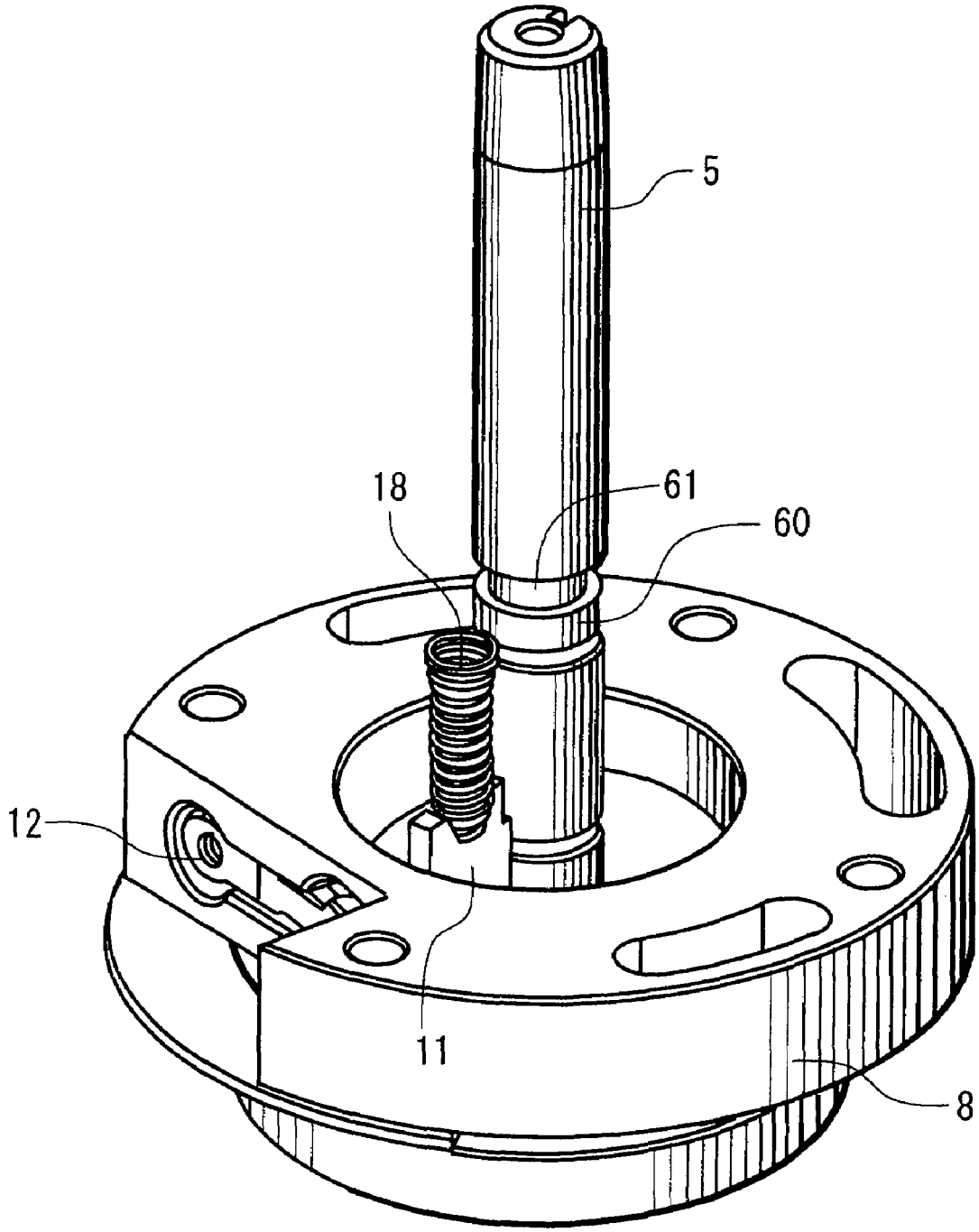
FIG. 20 is a perspective view showing the compression element of the compressor of FIG. 19.

Here, FIGS. 19 and 20 show one example of a compressor C in this case. FIG. 19 is a vertical sectional side view of a rotary shaft 5 and a compression element 3, and FIG. 20 shows a perspective view of the rotary shaft 5 in a state in which a cylinder 8 is mounted. As shown in FIGS. 19 and 20, a groove 61 is formed in an outer peripheral surface of the rotary shaft 5 disposed in a position corresponding to an end portion of a bearing on a side opposite to a compression member 9 with respect to a sub-bearing 23 on a lower surface (the other surface) side of the compression member 9, that is, the bearing on an upper surface 33 side of the compression member 9, and a piston ring seal 60 is mounted in this groove 61. The piston ring seal 60 has a ring shape having a width of about 3 mm to 10 mm, and is constituted of a material superior in a stretching property and durability, such as a rubber material. It is to be noted that the width of the piston ring seal 60 is set to be equal to or less (the piston ring seal 60 of the embodiment has a width of about 3 mm to 10 mm) than a depth (width) of the groove 61. That is, since an outer diameter of the piston ring seal 60 is set to be not more than that of the rotary shaft 5, the piston ring seal 60 is stored in the groove 61 without protruding an outer peripheral edge of the piston ring seal 60 from the outer peripheral surface of the rotary shaft 5 in a state in which the piston ring seal is mounted in the groove 61.

Moreover, when the compressor C starts to obtain a high pressure inside a sealed container 1, the piston ring seal 60 is pressed downward by the high pressure in the sealed container 1, which has been applied from above, and the seal expands (pushed outward). Therefore, a gap between a support member 7 and the rotary shaft 5 is sufficiently sealed by the piston ring seal 60.

As described above, the piston ring seal 60 achieves sufficient sealing on an inner surface of the main bearing 13, and it is possible to avoid in advance a disadvantage that a refrigerant gas in a compression space 21 leaks from a clearance of the main bearing 13 between the rotary shaft 5 and the support member 7. Therefore, sliding losses in the end portion of the main bearing 13 can be reduced. It is simultaneously possible to realize improvement of a volume efficiency by enhancement of a sealability. Consequently, a performance of the compressor C can be enhanced.

Moreover, in the present embodiment, one piston ring seal 60 is disposed in a position corresponding to the main bearing 13, but a position where the piston ring seal 60 is to be installed is not limited to the above-described position, and the seal may be attached to the rotary shaft 5 connected to the sub-bearing 23. A plurality of piston ring seals 60 may be used. Accordingly, it is possible to enhance more the sealability between the rotary shaft 5 and the main bearing 13 or the sub-bearing 23, and there can be provided a high-performance compressor.

It is to be noted that in the above-described embodiments, the vertical compressor C has been described in which the driving element 2 is stored in the upper part of the sealed container 1, and the compression element 3 is stored in the lower part of the container. The present invention is not limited to the embodiments, and is effective even when applied to a vertical compressor containing the compression element in the upper part of the sealed container and the driving element in the lower part thereof, or a horizontal compressor.

Moreover, in the above-described embodiments, the compression space 21 is disposed on the driving element 2 side of the compression member 9 on the upper surface 33 side of the compression member 9, but the compression space 21 may be disposed in a surface on a side opposite to the driving element 2.

Third Embodiment

Figure 21:
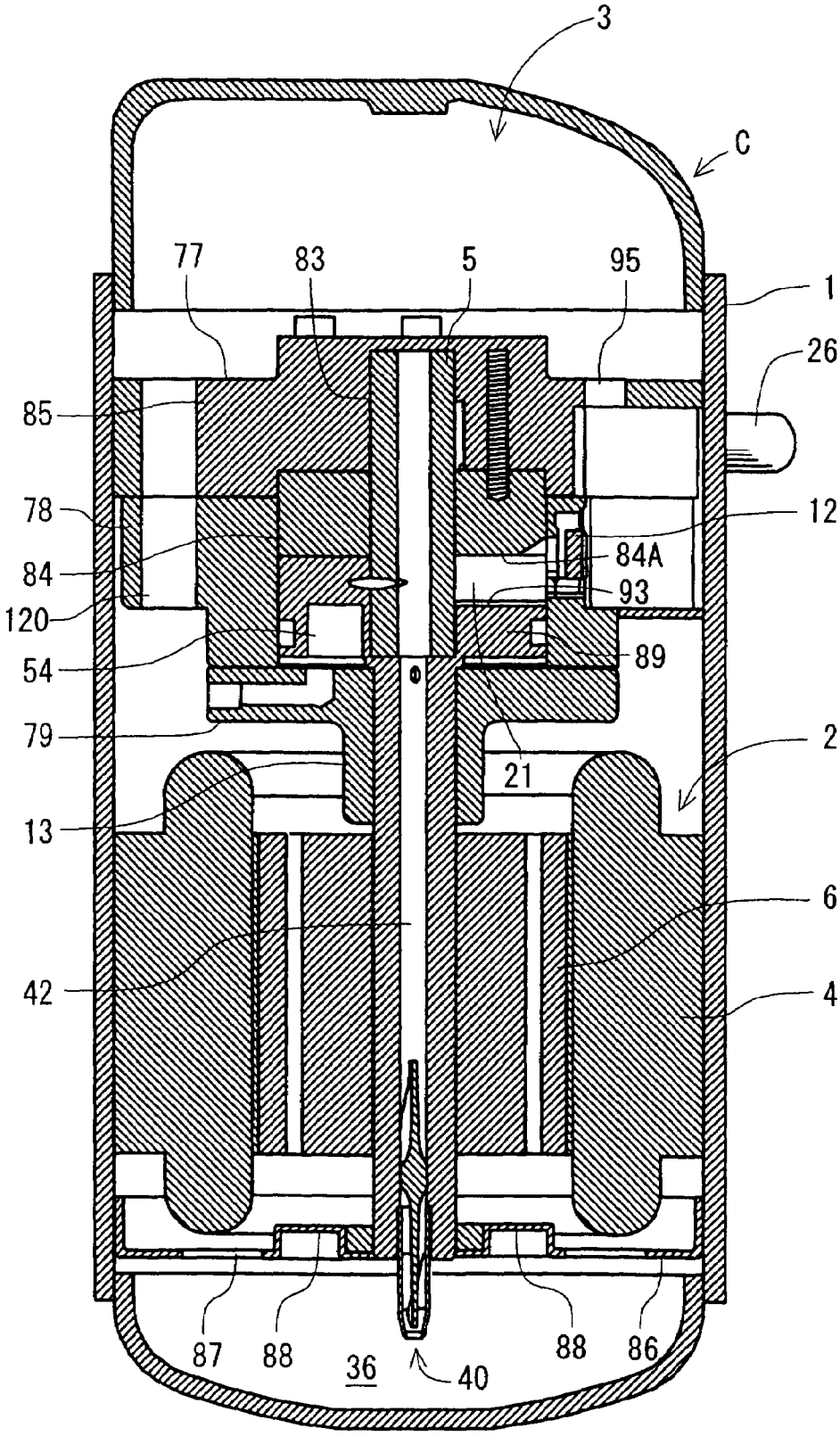
FIG. 21 is a vertical sectional side view showing the compressor according to a third embodiment of the present invention.
Figure 22:
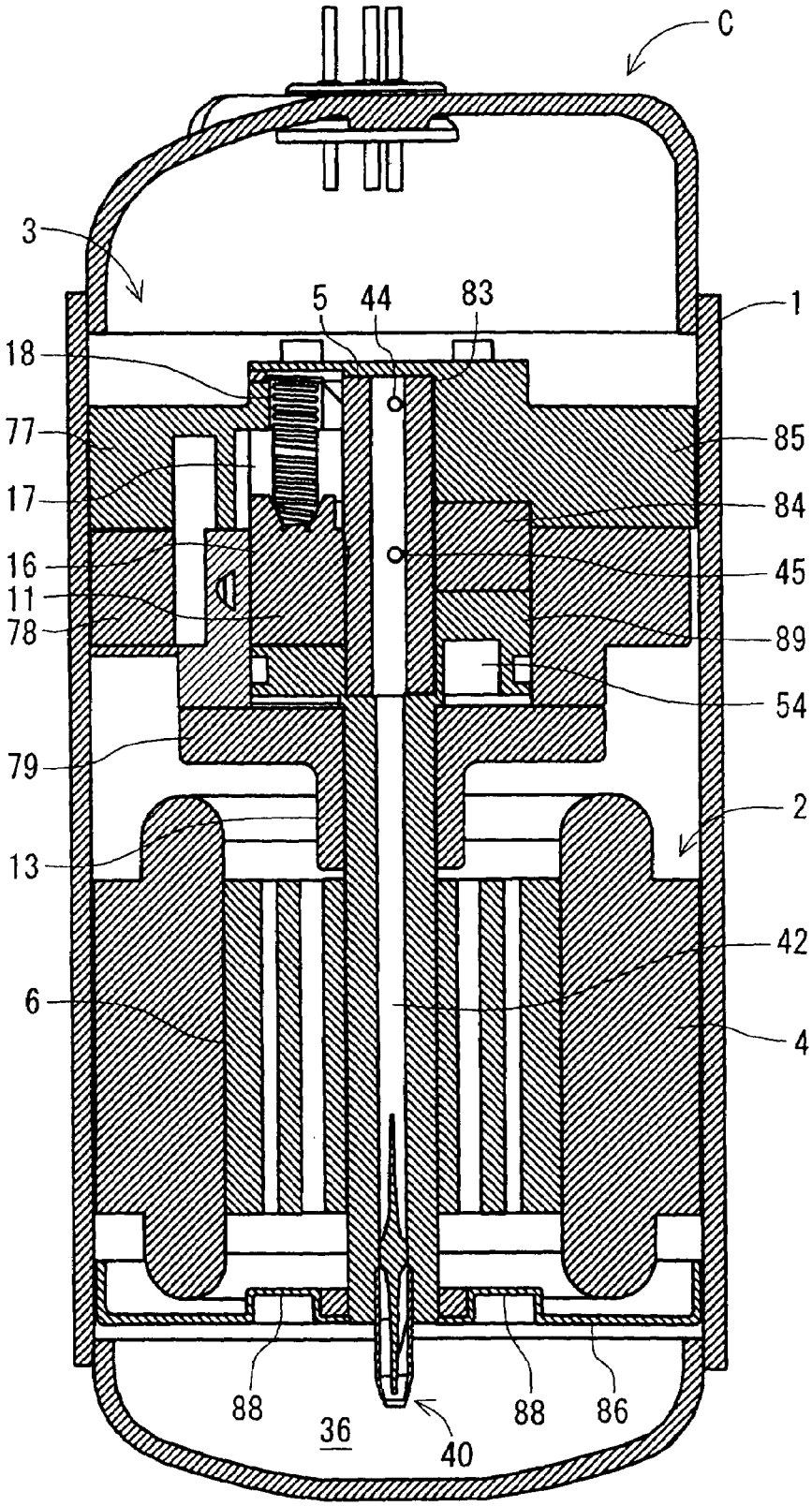
FIG. 22 is another vertical sectional side view of the compressor of FIG. 21.
Figure 23:
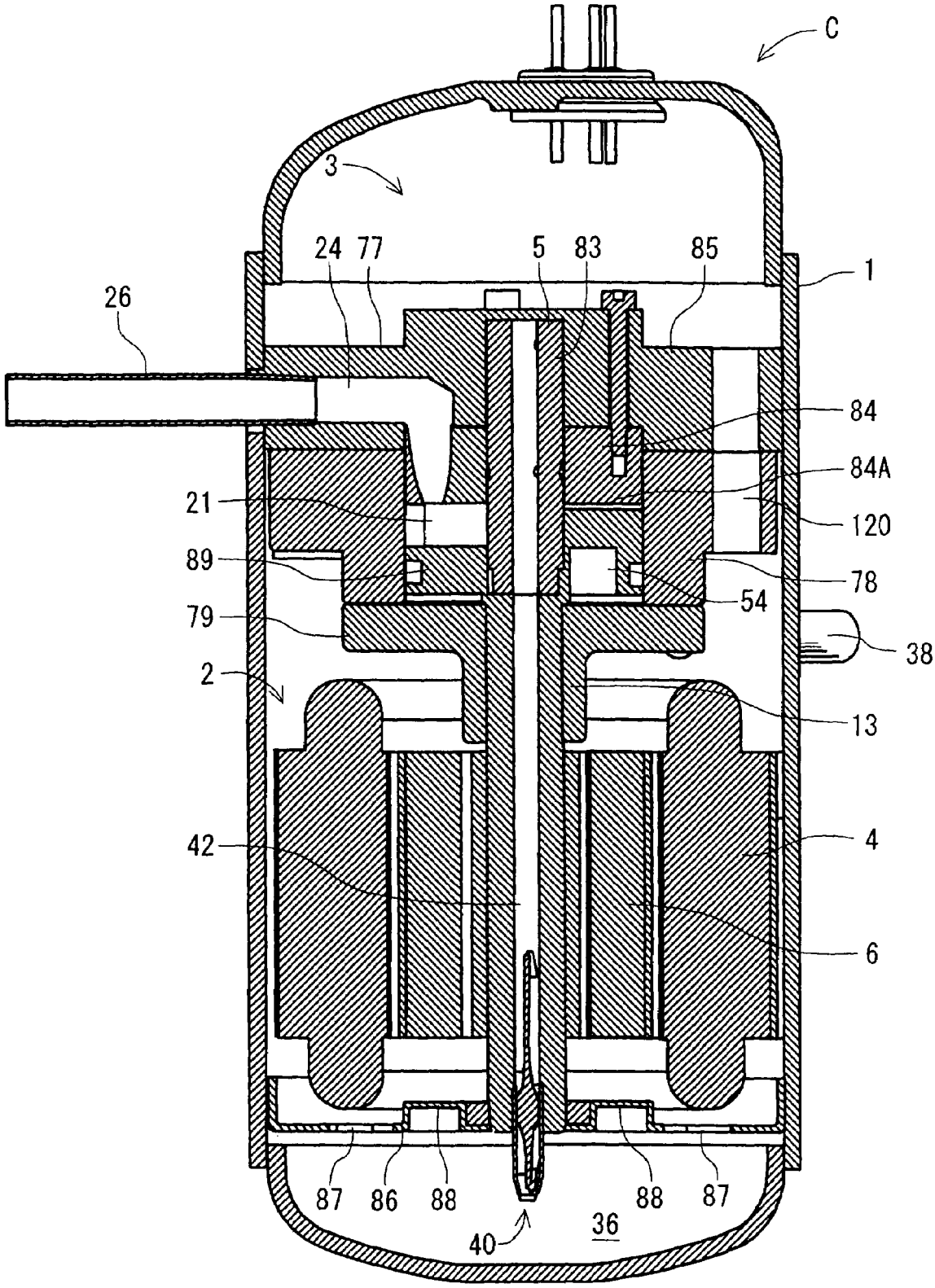
FIG. 23 is another vertical sectional side view of the compressor of FIG. 21.

Next, a third embodiment of the present invention will be described with reference to FIGS. 21 to 23. FIG. 21 is a vertical sectional side view showing a compressor C in this case, FIG. 22 is another vertical sectional side view of the compressor C, and FIG. 23 is another vertical sectional side view of the compressor C. It is to be noted that in FIGS. 21 to 23, components denoted with the same reference numerals as those shown in FIGS. 1 to 20 produce similar effects.

In the present embodiment, a compression element 3 is stored in an upper part of a sealed container 1, and a driving element 2 is stored in a lower part thereof. That is, in the present embodiment, the compression element 3 is disposed above the driving element 2.

The driving element 2 is an electromotive motor which is fixed to an inner wall of the sealed container 1 and which comprises a stator 4 having a stator coil wound therearound and a rotor 6 having a rotary shaft 5 in a center inside the stator 4 in the same manner as in the above-described embodiments.

The compression element 3 comprises: a support member 77 fixed to the inner wall of the sealed container 1 and positioned on an upper end side of the rotary shaft 5; a cylinder 78 attached to a bottom surface of the support member 77 by bolts; a compression member 89, a vane 11, and a discharge valve 12 arranged in the cylinder 78; and a main support member 79 attached to an underside of the cylinder 78 via bolts and the like. A lower surface central portion of the main support member 79 concentrically projects downward, and a main bearing 13 of the rotary shaft 5 is formed therein. An upper surface of the main support member 79 closes a lower opening of the cylinder 78.

A slot 16 is formed in a projected part 84 of the support member 77, and the vane 11 is inserted into this slot 16 to reciprocate up and down. A back pressure chamber 17 is formed in an upper part of the slot 16, and a coil spring 18 is arranged as urging means in the slot 16 to urge an upper surface of the vane 11 downward.

Moreover, an upper opening of the cylinder 78 is closed by the support member 77, so that a compression space 21 is constituted inside the cylinder 78 (between the compression member 89 and the projected part 84 of the support member 77 in the cylinder 78). A suction passage 24 is formed in a main member 85 and the projected part 84 of the support member 77, and a suction pipe 26 is attached to the sealed container 1 to be connected to one end of the suction passage 24. A suction port and a discharge port are formed in the cylinder 78 to communicate with the compression space 21. The other end of the suction passage 24 communicates with the suction port. Additionally, the vane 11 is positioned between the suction port and the discharge port.

The rotary shaft 5 is rotatably supported by the main bearing 13 formed on the main support member 79, a sub-bearing 83 formed on the support member 77, and a sub-bearing 86 formed on a lower end. That is, the rotary shaft 5 is inserted into centers of the main support member 79, the cylinder 78, and the support member 77, and its center of an up-and-down direction is rotatably supported by the main bearing 13. An upper part of the rotary shaft 5 is rotatably supported by the sub-bearing 83, and an upper end thereof is covered with the support member 77. Furthermore, a lower part of the rotary shaft 5 is supported by the sub-bearing 86. This sub-bearing 86 is disposed under the driving element 2, and substantially has a donut shape in which a hole for passing the rotary shaft 5 is disposed in a central portion. An outer peripheral edge of the sub-bearing rises in an axial center direction, and the sub-bearing is fixed to the inner wall of the sealed container 1. Several vertically communicating holes 87 are formed in this sub-bearing 86. Recesses 88 formed in the sub-bearing 86 have a vibration absorbing function of preventing vibration transmitted from the driving element 2 or the like to the rotary shaft 5 from being transmitted to the sealed container 1 via the sub-bearing 86.

As described above, the bearings of the rotary shaft 5 are disposed in the upper part (sub-bearing 83) of the compression element 3, the lower part (main bearing 13) thereof, and in the lower part (sub-bearing 86) of the driving element 2. Consequently, the rotary shaft 5 is stably supported, and the vibration generated in the compressor C can be effectively reduced. This can achieve enhancement of a vibration characteristic of the compressor C.

Moreover, when the compression space 21 is disposed in an upper surface 93 of the compression member 89 on a side opposite to the driving element 2 as in the present embodiment, gas leakage from the main bearing 13 is not easily generated, and sealability of the main bearing 13 can be enhanced. Furthermore, when the upper end of the rotary shaft 5 is closed by the support member 77, the sealability of the sub-bearing 83 is improved, and it is possible to avoid a disadvantage that a peripheral surface of the rotary shaft 5 has a high pressure.

It has heretofore been difficult to supply oil from an oil reservoir 36 in a bottom part of the sealed container 1 to a sliding portion such as the compression member 89 of the compression element 3 in a case where the compression element 3 is disposed in the upper part of the sealed container 1.

That is, since a high-pressure gas enters the peripheral surface of the rotary shaft 5 to provide the high pressure, it has not been possible to supply the oil smoothly from oil holes 44, 45 disposed in the upper part of the rotary shaft 5.

However, when the upper end of the rotary shaft 5 is closed by the support member 77, the sealability of the sub-bearing 83 can be improved, and it is possible to avoid the disadvantage that the peripheral surface of the rotary shaft 5 has the high pressure. Therefore, it is possible to supply the oil to a sliding portion such as the compression member 89 disposed in the upper part of the sealed container 1 by an oil pump 40, and an oil supply amount can be optimized.

Moreover, the compression member 89 is formed integrally with the upper part of the rotary shaft 5, and disposed in the cylinder 78. This compression member 89 is rotated by the rotary shaft 5 to compress a fluid (refrigerant) sucked from the suction port and discharge the fluid into the sealed container 1, and has a substantially columnar shape concentric to the rotary shaft 5 as a whole.

Moreover, the upper surface 93 (one surface) of the compression member 89 crossing an axial direction of the compression member 9 exhibits an inclined shape which extends from a highest top dead center to a lowest bottom dead center to return to the top dead center and which is continuous between the top dead center and the bottom dead center.

One surface of the compression member 89 having a continuously inclined shape is disposed on the upper surface 93 which is a surface on a side opposite to the driving element 2 stored in the lower part of the sealed container 1 of the compression member 89.

It is to be noted that since the shape of the upper surface 93 of the compression member 89 is the same as that of the upper surface 33 of the compression member 9 of the first embodiment, description thereof is omitted. Similarly, hardness of the upper surface 93 (one surface) of the compression member 89 is set to be higher than that of a lower surface 84A of the projected part 84 of the support member 77. The same materials and working methods as those described in detail in the first embodiment are used as those of the upper surface 93 of the compression member 89 and the vane 11 (see FIG. 18). Consequently, durability of the compression member 89 and the vane 11 can be improved in the same manner as in the above-described embodiments.

Next, when the vane 11 is constituted of a carbon-based material, a ceramic-based material, a fluorine resin-based material, or polyether ether ketone, the material and the working shown in FIG. 18 are used in the upper surface 93 of the compression member 89. Accordingly, a hardness difference is made between the upper surface 93 of the compression member 89 and the vane 11. Moreover, even in a case where oil supplied to the sliding portion is insufficient or the compression element 3 is non-lubricated, a satisfactory slidability can be retained.

On the other hand, the vane 11 is disposed between the suction port and the discharge port, and abuts on the upper surface 93 of the compression member 89 to partition the compression space 21 of the cylinder 78 into a low pressure chamber and a high presser chamber. The coil spring 18 always urges the vane 11 toward the upper surface 93.

A lower opening of the cylinder 78 is closed by the sub-support member 79, and a space 54 is formed between the lower surface (the other surface) of the compression member 89 and the main support member 79 (on a back-surface side of the compression space 21). This space 54 is a space closed by the compression member 89 and the main support member 79. Moreover, a slight amount of the refrigerant flows from the compression space 21 into the space 54 via a clearance between the compression member 89 and the cylinder 78. Therefore, the pressure of the space 54 is set to a value which is higher than that of a low-pressure refrigerant sucked into the suction port and which is lower (intermediate pressure) than that of a high-pressure refrigerant in the sealed container 1.

When the pressure of the space 54 is set to an intermediate pressure in this manner, it is possible to avoid a disadvantage that the compression member 89 is strongly pushed upward by the pressure of the space 54 and that the upper surface 93 of the compression member 89 as a receiving surface, and the lower surface 84A of the projected part 84 are remarkably worn. Consequently, the durability of the upper surface 93 of the compression member 89 can be improved.

Furthermore, when the pressure of the space 54 on the other surface side of the compression member 89 is set to an intermediate pressure, the pressure of the space 54 is lower than that in the sealed container 1. Therefore, it is possible to supply the oil smoothly to the compression member 89 which is a peripheral portion of the space 54, or the vicinity of the main bearing 13 utilizing the pressure difference.

On the other hand, the back pressure chamber 17 is not set to the high pressure unlike a conventional technology. The pressure of the back pressure chamber 17 as a sealed space is set to a value which is higher than that of the pressure of the refrigerant sucked into the suction port and which is lower than that of the pressure in the sealed container 1. In the conventional technology, a part of the back pressure chamber 17 is allowed to communicate with the inside of the sealed container 1, and the inside of the back pressure chamber 17 is set to a high pressure to urge the vane 11 downward in addition to the coil spring 18. However, in the present embodiment, the compression element 3 is positioned in the upper part of the sealed container 1. Therefore, when the back pressure chamber 17 is set to the high pressure, the oil supplied to the vicinity of the vane 11 might be insufficient.

Here, the back pressure chamber 17 is formed into a sealed space without being allowed to communicate with the inside of the sealed container 1. Accordingly, the refrigerant slightly flows into the back pressure chamber 17 from low and high pressure chamber sides of the compression space 21 via the gap of the vane 11. Therefore, the back pressure chamber 17 has an intermediate pressure which is higher than the pressure of the refrigerant sucked into the suction port and which is lower than the pressure inside the sealed container 1. Accordingly, since the pressure inside the back pressure chamber 17 is lower than that in the sealed container 1, the oil rises through the oil passage 42 in the rotary shaft 5 utilizing the pressure difference, and the oil can be supplied from the oil holes 44, 45 to the peripheral portion of the vane 11.

Consequently, even when the compression element 3 is disposed in the upper part of the sealed container 1, the oil can be smoothly supplied to sliding portions such as the compression member 89 and the vane 11, and reliability of the compressor C can be improved.

Moreover, a very small clearance is formed between a peripheral side face of the compression member 89 and an inner wall of the cylinder 78, whereby the compression member 89 freely rotates. The clearance between the peripheral side face of the compression member 89 and the inner wall of the cylinder 78 is also sealed with oil.

The discharge valve 12 is mounted to an outer side of the discharge port to be positioned in a side face of the compression space 21 of the cylinder 78, and a discharge pipe 95 is formed in the cylinder 78 and the support member 77 in such a manner as to allow the discharge valve 12 to communicate with the upper part of the sealed container 1. Moreover, the refrigerant compressed in the cylinder 78 is discharged from the discharge port into the upper part of the sealed container 1 via the discharge valve 12 and the discharge pipe 95.

Moreover, a through hole 120 extending through the cylinder 78 and the support member 77 in the axial center direction (vertical direction) is formed in a position substantially symmetric with the discharge valve 12 in the cylinder 78 and the support member 77. A discharge pipe 38 is attached to a position corresponding to a lower portion under the through hole 120 in the side surface of the sealed container 1. The refrigerant discharged from the discharge pipe 95 to the upper part of the sealed container 1 as described above passes through the through hole 120, and is discharged from the discharge pipe 38 to the outside of the compressor C. It is to be noted that an oil pump 40 is disposed on a lower end of the rotary shaft 5, and one end of the pump is immersed in the oil reservoir 36 in a bottom part of the sealed container 1. Moreover, the oil pumped up by the oil pump 40 is supplied to the sliding portion or the like of the compression element 3 via an oil passage 42 formed in the center of the rotary shaft 5 and the oil holes 44, 45 formed ranging from the oil passage 42 to the side surface of the compression element 3 in the axial direction of the rotary shaft 5. In the sealed container 1, a predetermined amount of carbon dioxide ($CO_2$), R-134a, or HC-based refrigerant is sealed in.

According to the aforementioned constitution, when power is supplied to the stator coil of the stator 4 of the driving element 2, the rotor 6 is rotated clockwise (seen from the bottom). The rotation of the rotor 6 is transmitted through the rotary shaft 5 to the compression member 89, whereby the compression member 89 is rotated clockwise in the cylinder 78 (seen from the bottom). Now, it is assumed that the top dead center (not shown) of the upper surface 93 of the compression member 89 is on the vane 11 side of the discharge port, and the refrigerant in a refrigerant circuit is sucked from the suction port through the suction pipe 26 and the suction passage 24 into a space (low pressure chamber) surrounded with the cylinder 78, the support member 77, the compression member 89 and the vane 11 on the suction port side of the vane 11.

Moreover, when the compression member 89 is rotated in this state, a volume of the space is narrowed due to inclination of the upper surface 93 from a stage at which the top dead center passes through the vane 11 and the suction port, and the refrigerant in a space (high pressure chamber HR) is compressed. Then, the refrigerant compressed until the top dead center passes through the discharge port 28 is continuously discharged from the discharge port. On the other hand, after the passage of the top dead center through the suction port, the volume of the space (low pressure chamber) surrounded with the cylinder 78, the support member 79, the compression member 89 and the vane 11 on the suction port side of the vane 11 is expanded. Accordingly, the refrigerant is sucked from the refrigerant circuit through the suction pipe 26, the suction passage 24, and the suction port into the compression space 21.

The refrigerant is discharged from the discharge port through the discharge valve 12 and the discharge pipe 95 into the upper part of the sealed container 1. Then, the high-pressure refrigerant discharged into the sealed container 1 passes through the upper part of the sealed container 1, and discharged through the through hole 120 formed in the support member 77 and the cylinder 78 into the refrigerant circuit via the discharge pipe 38. On the other hand, the separated oil flows down through the through hole 120, and further flows down from between the sealed container 1 and the stator 4 to return into the oil reservoir 36.

It is to be noted that in the present embodiment, the back pressure chamber 17 is formed into the sealed space, and the pressure of the back pressure chamber 17 applied as the back pressure of the vane 11 is set to a value which is higher than that of the pressure of the refrigerant sucked into the suction port and which is lower than that of the pressure in the sealed container 1. The present invention is not limited to a case where the back pressure chamber 17 is formed into the sealed space in this manner. For example, the back pressure chamber 17 may communicate with the inside of the sealed container 1 via a small passage (nozzle). In this case, since the refrigerant flows from the sealed container 1 through the nozzle into the back pressure chamber 17, the pressure of the refrigerant drops while the refrigerant passes through the nozzle. Accordingly, the back pressure chamber 17 has a value which is higher than that of the pressure of the refrigerant sucked into the suction port and which is lower than that of the pressure in the sealed container 1. Therefore, the oil can be smoothly supplied to the peripheral portion of the vane 11 utilizing the pressure difference. When a diameter of the nozzle is adjusted, the pressure of the refrigerant flowing into the back pressure chamber 17 can be freely set.

Moreover, in the same manner as in the back pressure chamber 17, the space 54 on the other surface side of the compression member 89 has an intermediate pressure which is higher than the pressure of the low-pressure refrigerant sucked into the suction port and which is lower than the pressure of the high-pressure refrigerant in the sealed container 1. However, the space 54 may be allowed to communicate with the inside of the sealed container 1 via a fine passage (nozzle). In this case, since the refrigerant flows from the sealed container 1 through the nozzle into the space 54, the pressure of the refrigerant drops while the refrigerant passes through the nozzle. Accordingly, the space 54 indicates a value which is higher than that of the pressure of the refrigerant sucked into the suction port and which is lower than that of the pressure in the sealed container 1. Therefore, it is possible to avoid a disadvantage that the upper surface 93 of the compression member 89 which is the receiving surface, and the lower surface 84A of the projected part 84 are remarkably worn. Consequently, the durability of the upper surface 93 of the compression member 89 can be improved. Furthermore, when the space 54 is set to the intermediate pressure, it is possible to supply the oil smoothly to the compression member 89 which is the peripheral portion of the space 54, or the vicinity of the main bearing 13 utilizing the pressure difference. When the diameter of the nozzle is adjusted, the pressure of the refrigerant flowing into the space 54 can be freely set.

Fourth Embodiment

Figure 24:
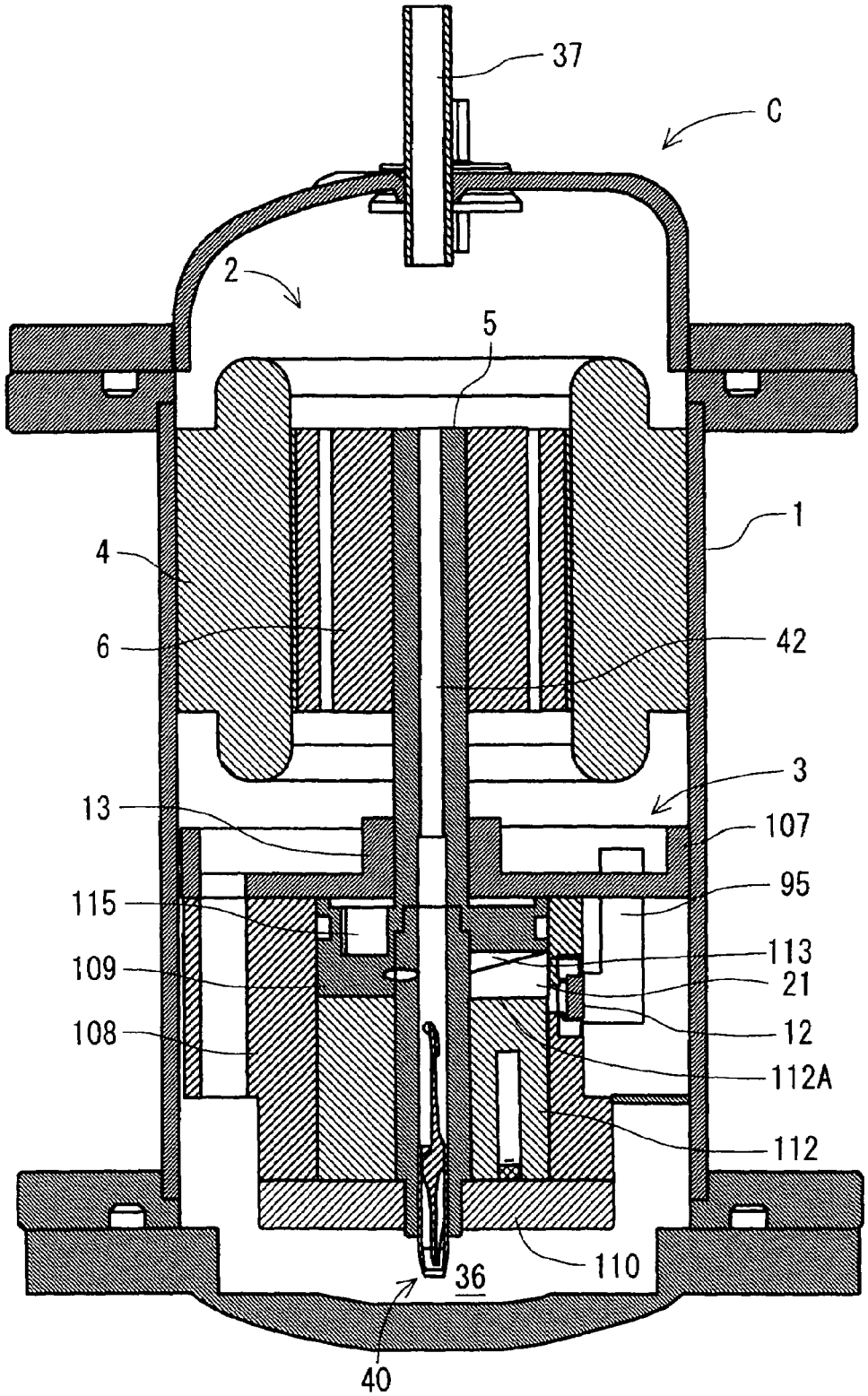
FIG. 24 is a vertical sectional side view showing the compressor according to a fourth embodiment of the present invention.
Figure 25:
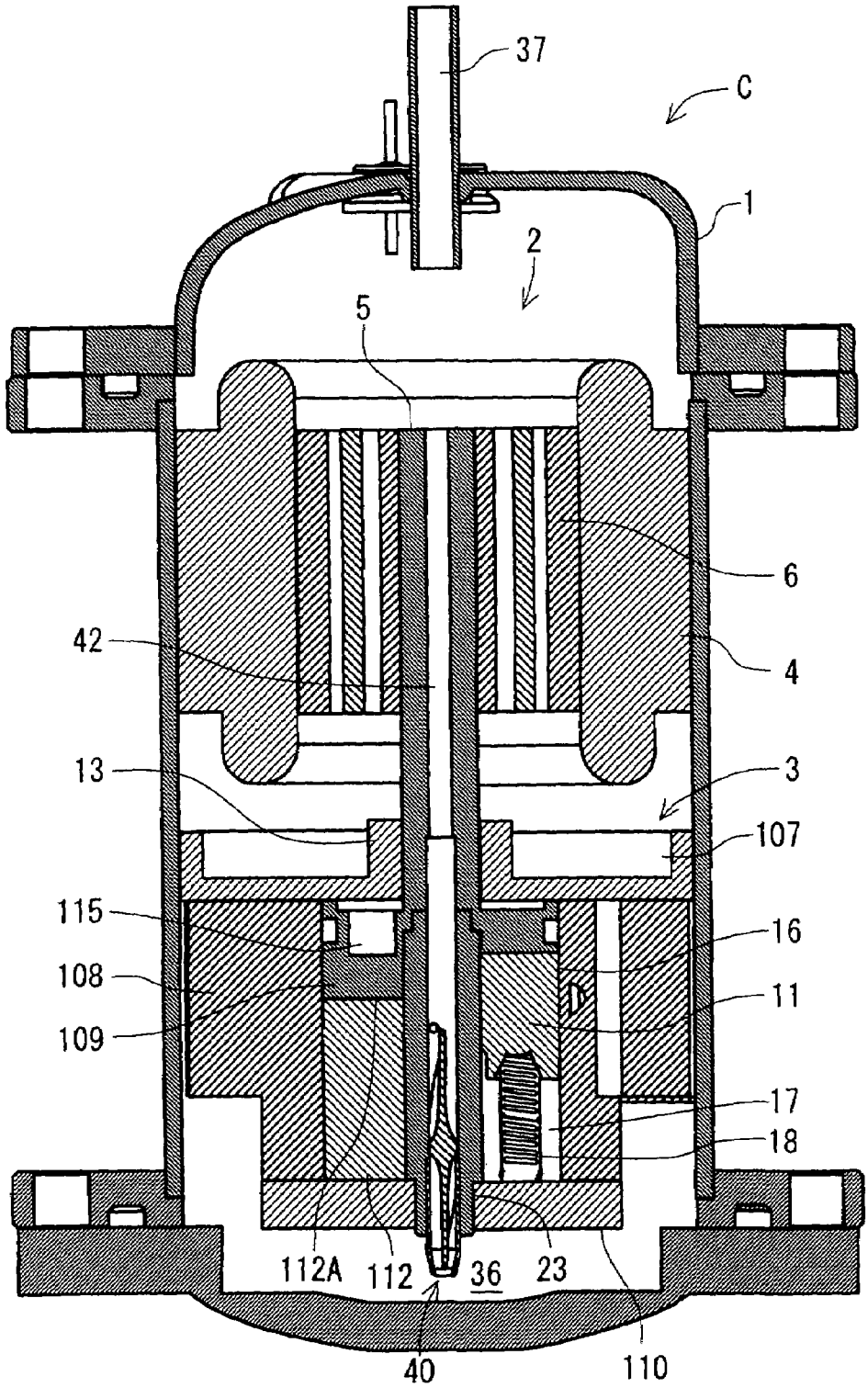
FIG. 25 is another vertical sectional side view of the compressor of FIG. 24.
Figure 26:
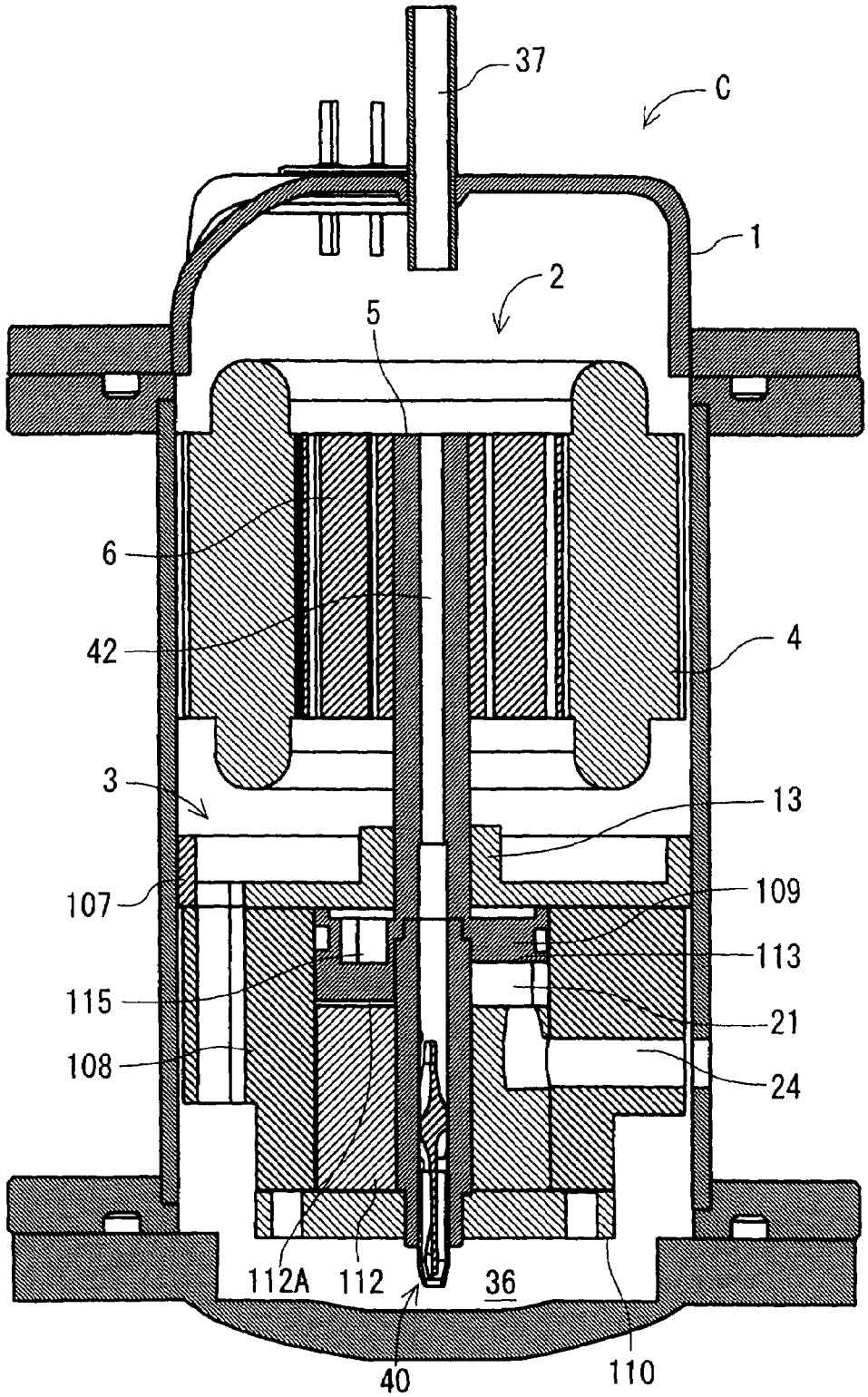
FIG. 26 is still another vertical sectional side view of the compressor of FIG. 24.

Next, a fourth embodiment of the present invention will be described with reference to FIGS. 24 to 26. FIGS. 24 to 26 are vertical sectional side views of a compressor C in this embodiment, and the respective FIGURES show different sections. It is to be noted that in FIGS. 24 to 26, components denoted with the same reference numerals as those shown in FIGS. 1 to 23 produce similar effects, and description thereof is therefore omitted.

In the present embodiment, a driving element 2 is disposed in an upper part of a sealed container 1, and a compression element 3 is disposed in a lower part thereof. That is, the compression element 3 is disposed under the driving element 2.

The compression element 3 comprises: a main support member 107 fixed to an inner wall of the sealed container 1; a cylinder 108 attached to a bottom surface of the main support member 107 by bolts; a compression member 109, a vane 11, and a discharge valve 12 arranged in the cylinder 108; and a sub-support member 110 attached to an underside of the cylinder 108 via bolts and the like. An upper surface central portion of the main support member 107 concentrically projects upward, and a main bearing 13 of a rotary shaft 5 is formed therein. An outer peripheral edge of the main bearing rises in an axial center direction (upward direction), and the raised outer peripheral edge is fixed to the inner wall of the sealed container 1 as described above.

Moreover, an upper opening of the cylinder 108 is closed by the main support member 107, and accordingly a sealed space 115 closed by the compression member 109 and the main support member 107 is formed between the upper surface (the other surface) of the compression member 109 disposed in the cylinder 108 and the main support member 107 (the other surface side of the compression member 109).

The sub-support member 110 comprises a main body, a sub-bearing 23 extended through a center of the main body, and a protruded member 112 fixed to the upper surface central portion by bolts. An upper surface 112A of the protruded member 112 is formed into a smooth surface.

Moreover, a lower opening of the cylinder 108 is closed by the protruded member 112 of the sub-support member 110, and accordingly a compression space 21 is formed inside the cylinder 108 (the inside of the cylinder 108 between the compression member 109 and the protruded member 112 of the sub-support member 110).

A slot 16 is formed in the protruded member 112 of the sub-support member 110, and the vane 11 is inserted into this slot 16 to reciprocate up and down. A back pressure chamber 17 is formed in a lower part of the slot 16, and a coil spring 18 is arranged as urging means in the slot 16 to urge the lower surface of the vane 11 upward.

Moreover, a suction passage 24 is formed in the cylinder 108 and the protruded member 112 of the sub-support member 110, and a suction pipe (not shown) is mounted in the sealed container 1, and connected to one end of the suction passage 24. A suction port and a discharge port which communicate with the compression space 21 are formed in the cylinder 108, and the other end of the suction passage 24 communicates with the suction port. The vane 11 is positioned between the suction port and the discharge port.

The rotary shaft 5 is rotatably supported by the main bearing 13 formed on the main support member 107 and the sub-bearing 23 formed on the sub-support member 110. That is, the rotary shaft 5 is inserted into centers of the main support member 107, the cylinder 108, and the sub-support member 110, and its center of an up-and-down direction is rotatably supported by the main bearing 13. A lower end of the rotary shaft is rotatably supported by the sub-bearing 23 of the sub-support member 110. Moreover, the compression member 109 is formed integrally in a position below the center of the rotary shaft 5, and disposed in the cylinder 108.

This compression member 109 is disposed in the cylinder 108, and rotated by the rotary shaft 5 to compress a fluid (refrigerant in the present embodiment) sucked from the suction port and discharge the fluid from the discharge port into the sealed container 1 via the discharge valve 12 and the discharge pipe 95. The member has a substantially columnar shape concentric to the rotary shaft 5 as a whole. The compression member 109 has a shape in which a thick part on one side is continuous with a thin part on the other side, and a lower surface 113 (one surface) crossing an axial direction of the rotary shaft 5 is an inclined surface which is low in the thick part and high in the thin part. That is, the lower surface 113 has an inclined shape which extends from a highest top dead center to a lowest bottom dead center to return to the top dead center and which is continuous between the top dead center and the bottom dead center (not shown).

One surface of the compression member 109 having a continuously inclined shape is disposed on the lower surface 113 which is a surface on a side opposite to the driving element 2 stored in the upper part of the sealed container 1 of the compression member 109.

Moreover, the discharge pipe 95 of the present embodiment is a pipe which extends from the discharge port 28 onto an oil surface of the oil reservoir 36 in the lower part of the sealed container 1. The refrigerant compressed in the cylinder 108 is discharged from the discharge port 28 through the discharge valve 12 and the discharge pipe 95 onto the oil surface in the sealed container 1.

It is to be noted that since the shape of the lower surface 113 of the compression member 109 is the same as that of the upper surface 33 of the compression member 9 of the first embodiment, description thereof is omitted. Similarly, hardness of the lower surface 113 (one surface) of the compression member 109 is set to be higher than that of the upper surface 112A of the protruded member 112 of the sub-support member 110 as a receiving surface of a top dead center 33A. The same materials and working methods as those described in detail in the first embodiment are used as those of the lower surface 113 of the compression member 109 and the vane 11 (see FIG. 18). Consequently, durability of the compression member 89 and the vane 11 can be improved in the same manner as in the above-described embodiments.

Especially, when the vane 11 is constituted of a carbon-based material, a ceramic-based material, a fluorine resin-based material, or polyether ether ketone, the material and the working shown in FIG. 18 are used in the lower surface 113 of the compression member 109. Accordingly, a hardness difference is made between the lower surface 113 of the compression member 109 and the vane 11. Moreover, even in a case where oil supplied to the sliding portion is insufficient or the compression element 3 is non-lubricated, a satisfactory slidability can be retained.

On the other hand, the vane 11 is disposed between the suction port and the discharge port as described above, and abuts on the lower surface 113 of the compression member 109 to partition the compression space 21 of the cylinder 108 into a low pressure chamber and a high presser chamber. The coil spring 18 always urges the vane 11 toward the lower surface 113.

Moreover, the space 115 is a space sealed by the compression member 109 and the main support member 107 as described above. However, since the refrigerant slightly flows from the compression space 21 via the clearance between the compression member 109 and the cylinder 108, the space 115 has an intermediate pressure which is higher than that of a low-pressure refrigerant sucked into the suction port and which is lower than the pressure of a high-pressure refrigerant in the sealed container 1.

When the pressure of the space 115 is set to the intermediate pressure in this manner, it is possible to avoid a disadvantage that the compression member 109 is strongly pressed upward by the pressure of the space 115 and that the lower surface 113 of the compression member 109 and the upper surface 112A of the protruded member 112 as the receiving surface are remarkably worn. Consequently, durability of the lower surface 113 of the compression member 109 can be improved.

Moreover, when the pressure of the space 115 on the other surface side of the compression member 109 is set to the intermediate pressure, the pressure in the sealed container 1 becomes lower than that of the space 115. Therefore, it is possible to supply the oil smoothly to the compression member 109 which is a peripheral portion of the space 115, or the vicinity of the main bearing 13 utilizing the pressure difference.

Furthermore, since the compression space 21 is disposed in the lower surface 113 of the compression member 109 on a side opposite to the driving element 2, gas leakage from the main bearing 13 is not easily generated, and sealability of the main bearing 13 can be enhanced. Since the sub-bearing 23 on the lower surface 113 side of the compression member 109 forming the compression space 21 is positioned in an oil reservoir 36, the gas leakage from the sub-bearing 23 can be avoided by the oil. The sealability of the sub-bearing 23 is enhanced, and it is possible to avoid a disadvantage that the peripheral surface of the rotary shaft 5 has a high pressure. Consequently, it is possible to perform the smooth oil supply utilizing the pressure difference.

On the other hand, in the same manner as in the above-described embodiment (third embodiment), the back pressure chamber 17 is not set to the high pressure unlike a conventional technology. The pressure of the back pressure chamber 17 as a sealed space is set to a value which is higher than that of the pressure of the refrigerant sucked into the suction port and which is lower than that of the pressure in the sealed container 1. Therefore, since the pressure in the back pressure chamber 17 is lower than that in the sealed container 1, the oil rises through the oil passage 42 in the rotary shaft 5 utilizing the pressure difference, and the oil can be supplied from oil holes (not shown) formed ranging from the oil passage 42 to a side surface of the compression member 109 in an axial direction of the rotary shaft 5 to the peripheral portion of the vane 11.

A very small clearance is formed between a peripheral side face of the compression member 109 and an inner wall of the cylinder 108, whereby the compression member 109 freely rotates. The clearance between the peripheral side face of the compression member 109 and the inner wall of the cylinder 108 is also sealed with oil.

The discharge valve 12 is mounted to an outer side of the discharge port to be positioned in a side face of the compression space 21 of the cylinder 108, and a discharge pipe 95 is formed externally with respect to the discharge valve 12 in the cylinder 108 and the main support member 107. An upper end of the discharge pipe 95 opens in the oil surface in the oil reservoir 36.

In this manner, the refrigerant gas discharged from the discharge port is passed through the discharge pipe 95, and guided onto the oil surface, so that pulsations of the discharged refrigerant can be reduced.

As described above in detail, even in the present embodiment, the oil can be smoothly supplied to sliding portions such as the compression member 109 and the vane 11, and reliability of the compressor C can be improved. In the third embodiment, the bearings of the rotary shaft 5 are disposed in three places: the upper part (sub-bearing 83) of the compression element 3; the lower part (main bearing 13) of the element; and the lower part (sub-bearing 86) of the driving element 2. However, since the rotary shaft 5 can be sufficiently supported by two bearings: the main bearing 13; and the sub-bearing 23, the number of components can be reduced, and the compressor can be inexpensively constituted.

Fifth Embodiment

Figure 27:
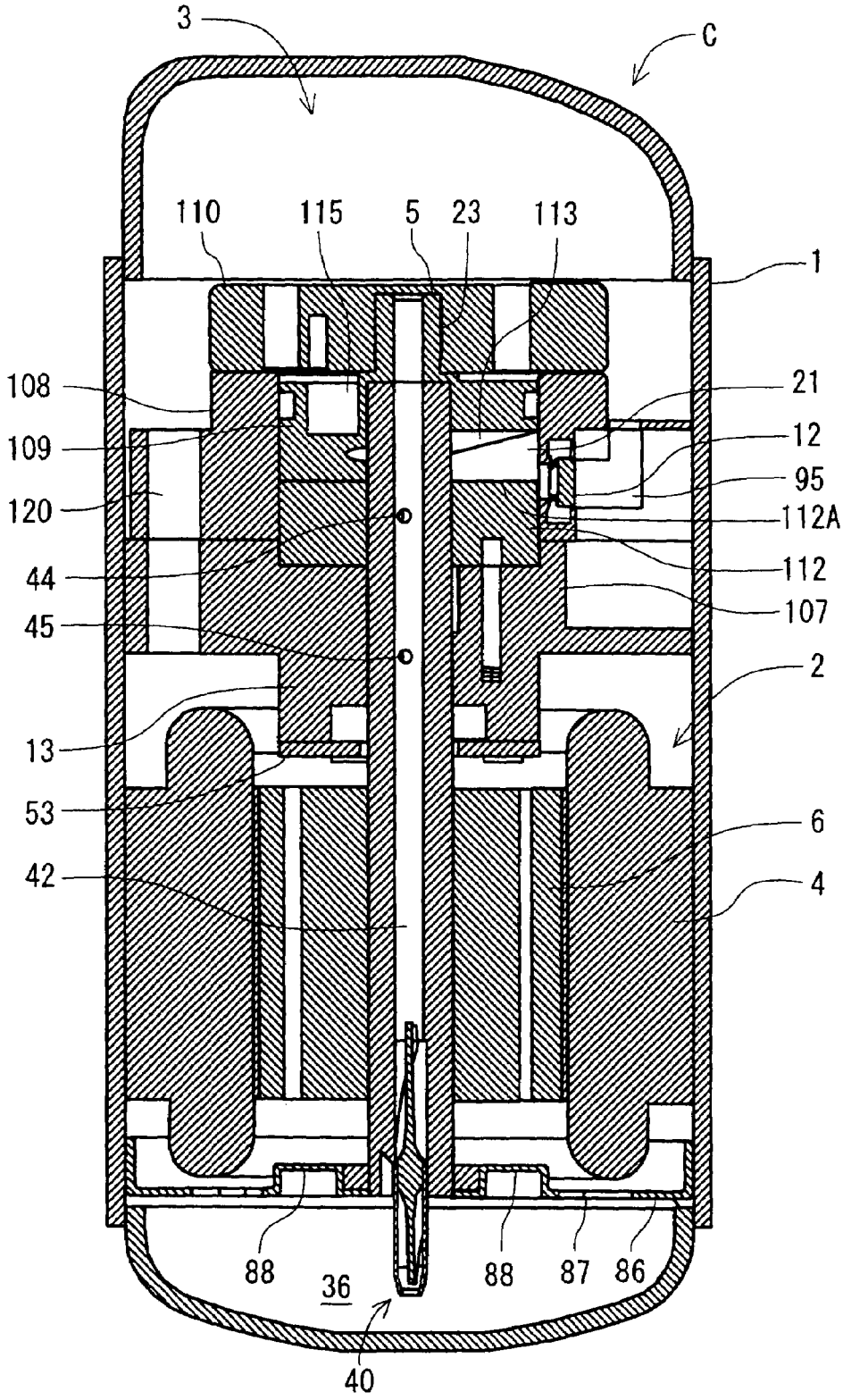
FIG. 27 is a vertical sectional side view showing the compressor according to a fifth embodiment of the present invention.
Figure 28:
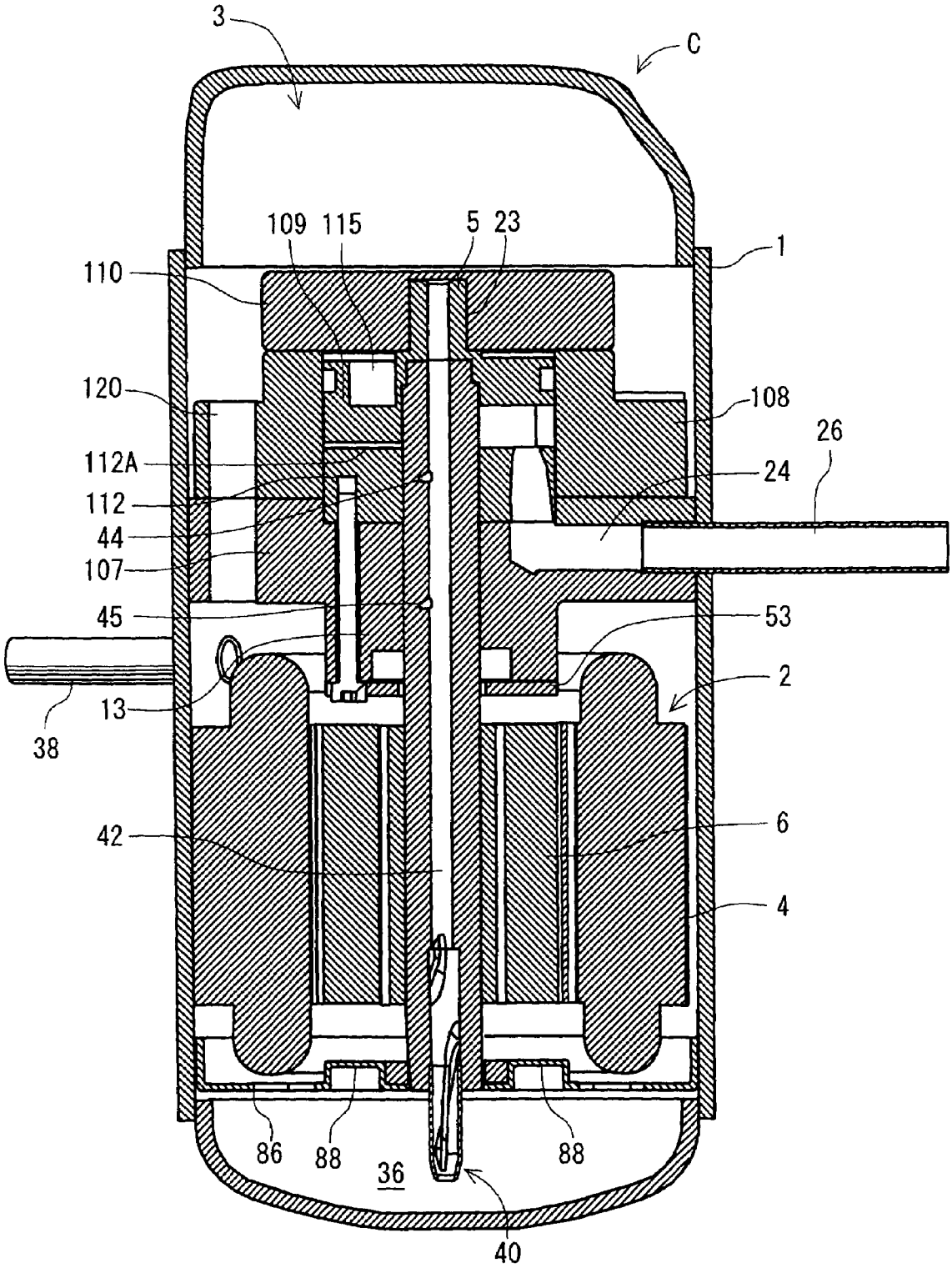
FIG. 28 is another vertical sectional side view of the compressor of FIG. 27.
Figure 29:
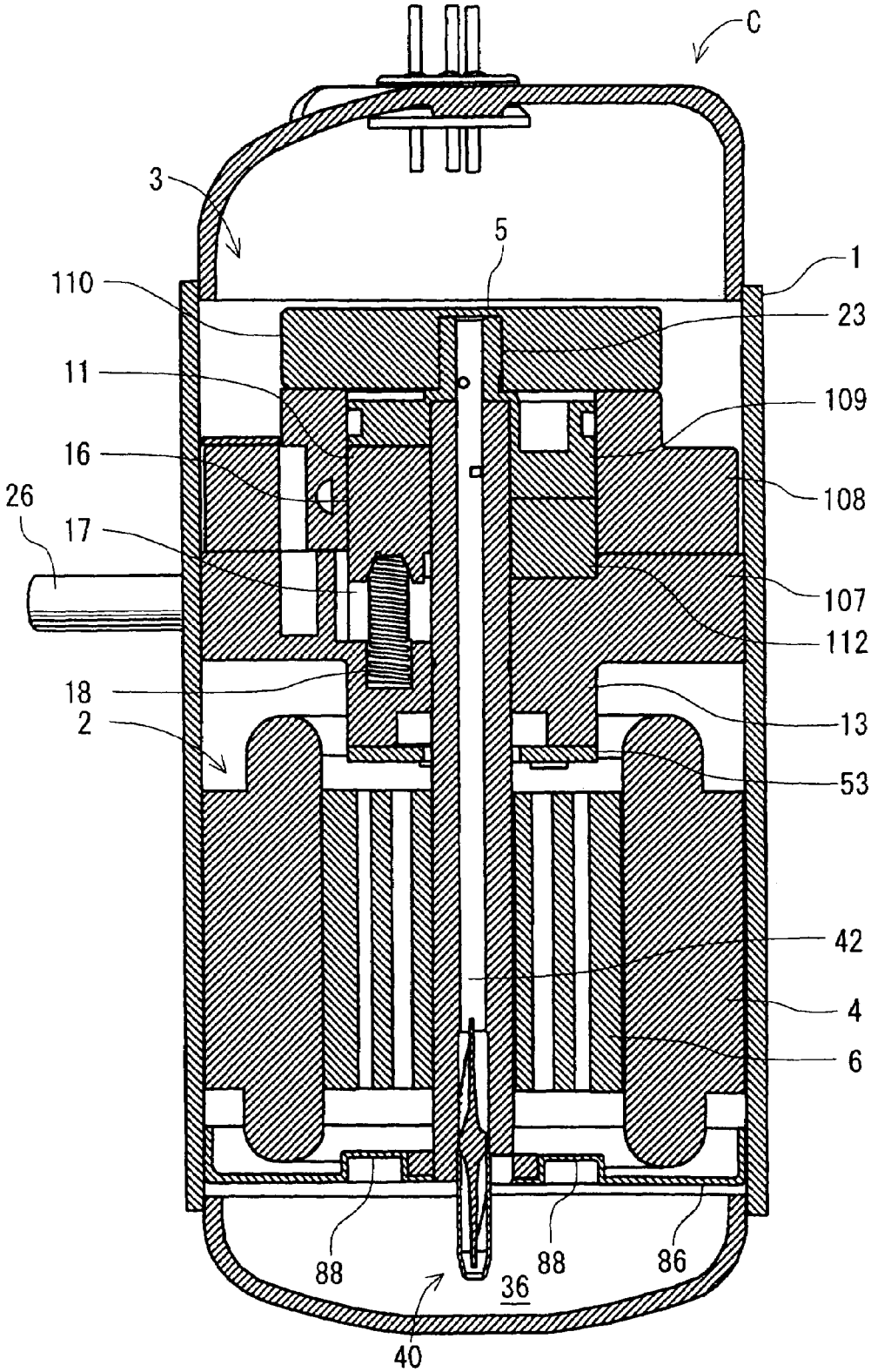
FIG. 29 is still another vertical sectional side view of the compressor of FIG. 27.

Next, FIGS. 27 to 29 show a compressor C according to a fifth embodiment. FIGS. 27 to 29 are vertical sectional side views of the compressor C of the fifth embodiment, and the respective FIGURES show different sections. It is to be noted that in FIGS. 27 to 29, components denoted with the same reference numerals as those shown in FIGS. 1 to 26 produce similar effects, and description thereof is therefore omitted.

In the present embodiment, a driving element 2 is disposed in a lower part of a sealed container 1, and a compression element 3 is disposed in an upper part thereof. A compression space 21 of the compression element 3 is disposed on a lower surface side which is a driving element 2 side of a compression member 109, and a lower surface (one surface) 113 of the compression member 109 is formed into a shape inclined continuously between an top dead center and a bottom dead center. Here, in the same manner as in the above-described embodiments, hardness of the lower surface 113 (one surface) of the compression member 109 is set to be higher than that of an upper surface 112A of a protruded member 112 of the sub-support member 110 as a receiving surface of a top dead center 33A. The same materials and working methods as those described in detail in the first embodiment are used as those of the lower surface 113 of the compression member 109 and a vane 11 (see FIG. 18). Consequently, durability of the compression member 89 and the vane 11 can be improved in the same manner as in the above-described embodiments.

Especially, in a case where the vane 11 is constituted of a carbon-based material, a ceramic-based material, a fluorine resin-based material, or polyether ether ketone, the material and the working shown in FIG. 18 are used in the lower surface 113 of the compression member 109. Accordingly, a hardness difference is made between the lower surface 113 of the compression member 109 and the vane 11. Moreover, even in a case where oil supplied to the sliding portion is insufficient or the compression element 3 is non-lubricated, a satisfactory slidability can be retained.

On the other hand, a space 115 on the other surface side of the compression member 109 is formed into a space sealed by the compression member 109 and the main support member 107. Accordingly, since the refrigerant slightly flows from the compression space 21 via a clearance between the compression member 109 and the cylinder 108, the space 115 has an intermediate pressure which is higher than that of a low-pressure refrigerant sucked into the suction port and which is lower than the pressure of a high-pressure refrigerant in the sealed container 1.

When the pressure of the space 115 is set to the intermediate pressure in this manner, the compression member 109 is strongly pressed upward by the pressure of the space 115, and it is possible to avoid a disadvantage that the lower surface 113 of the compression member 109 and the upper surface 112A of the protruded member 112 as the receiving surface are remarkably worn. Consequently, durability of the lower surface 113 of the compression member 109 can be improved.

On the other hand, a slot 16 is formed in the main support member 107 and the cylinder 108, and the vane 11 is inserted into this slot 16 to reciprocate up and down. A back pressure chamber 17 is formed in a lower part of the slot 16, and a coil spring 18 is arranged as urging means in the slot 16 to urge the lower surface of the vane 11 upward. Moreover, the vane 11 abuts on the lower surface 113 of the compression member 109, and partitions the compression space 21 in the cylinder 108 into a low pressure chamber and a high pressure chamber. The coil spring 18 always urges the vane 11 toward the lower surface 113.

Moreover, a value of the pressure of the back pressure chamber 17 as the sealed space is set to be higher than that of the pressure of the refrigerant sucked into the suction port and lower than that of the pressure in the sealed container 1 as described above. When the back pressure chamber 17 is not allowed to communicate with the inside of the sealed container 1, and formed into a sealed space, the refrigerant on low and high pressure chamber sides of the compression space 21 slightly flows from the gap of the vane 11 into the back pressure chamber 17. Therefore, the back pressure chamber 17 has an intermediate pressure which is higher than the pressure of the refrigerant sucked into the suction port 27 and which is lower than the pressure in the sealed container 1. Accordingly, since the pressure in the back pressure chamber 17 is lower than that in the sealed container 1, the oil rises through the oil passage 42 in the rotary shaft 5 utilizing the pressure difference. The oil can be supplied from oil holes 44, 45 into a peripheral portion of the vane 11.

On the other hand, the space 115 on the other surface side of the compression member 109 is formed into the space sealed by the compression member 109 and the main support member 107. Accordingly, since the refrigerant slightly flows from the compression space 21 through the clearance between the compression member 109 and the cylinder 108, the space 115 has the intermediate pressure which is higher than the pressure of a low-pressure refrigerant sucked into the suction port 27 and which is lower than the pressure of a high-pressure refrigerant in the sealed container 1.

When the pressure of the space 115 is set to the intermediate pressure, it is possible to avoid a disadvantage that the compression member 109 is strongly pressed upward by the pressure of the space 115 and that the lower surface 113 of the compression member 109 and the upper surface 112A of the compression member 112 as a receiving surface are remarkably worn. Consequently, the durability of the lower surface 113 of the compression member 109 can be improved.

Furthermore, when the pressure of the space 115 on the other surface side of the compression member 109 is set to the intermediate pressure, the pressure of the space 115 is lower than that in the sealed container 1. Therefore, it is possible to supply the oil smoothly to the compression member 109 which is a peripheral portion of the space 115, or the vicinity of the main bearing 13 utilizing the pressure difference.

It is to be noted that in the above-described embodiments, there has been described examples of the compressor which is used in the refrigerant circuit of the refrigerator, but the present invention is not limited to the embodiments. The present invention is effective even when applied to a so-called air compressor for sucking, compressing, and discharging air. In the respective embodiments, there has been described the vertical compressor in which the driving element and the compression element are stored in the vertical direction in the vertical sealed container. The present invention is not limited to this example. The present invention is effective even when applied to a horizontal compressor.

What is claimed is:

1. A compressor comprising:

a driving element stored in a sealed container; and a compression element driven by a rotary shaft of the driving element, the compression element comprising:

a cylinder in which a compression space is constituted;

a suction port and a discharge port which communicate with the compression space in the cylinder;

a compression member having one surface side crossing an axial direction of the rotary shaft which is inclined continuously between a top dead center and a bottom dead center and which is rotatably disposed in the cylinder and which compresses a fluid sucked from the suction port to discharge the fluid from the discharge port into the compression space; and a vane which is disposed between the suction port and the discharge port to abut on the one surface side of the compression member and which partitions the compression space in the cylinder into a low pressure chamber and a high pressure chamber, wherein a pressure on an other surface side of the compression member, which is opposite the one surface side of the compression member, is set to a value which is lower than that of a pressure in the sealed container.

* * * * *